United States Patent [19]

DoMinH

[11] 4,243,737

[45] Jan. 6, 1981

[54] IMAGE FORMING COMPOSITION AND ELEMENTS WITH CO(III) COMPLEX, CONJUGATED $\pi$ BONDING COMPOUNDS AND PHOTOREDUCTANT

[75] Inventor: Thap DoMinH, Rochester, N.Y.

[73] Assignee: Eastman Kodak Company, Rochester, N.Y.

[21] Appl. No.: 854,573

[22] Filed: Nov. 25, 1977

Related U.S. Application Data

[60] Division of Ser. No. 627,416, Oct. 30, 1975, Pat. No. 4,075,019, which is a continuation-in-part of Ser. No. 461,172, Apr. 15, 1974, abandoned.

[51] Int. Cl.[2] ..... G03C 1/60; G03C 1/72

[52] U.S. Cl. ..... 430/170; 430/179; 430/188; 430/196; 430/200; 430/203; 430/207; 430/211; 430/235; 430/332; 430/341; 430/936

[58] Field of Search ..... 96/88, 90 R, 91 R, 115 R, 96/67, 89; 430/178, 179, 196, 332, 341, 936, 170, 188

[56] References Cited

U.S. PATENT DOCUMENTS

| | | | |
|---|---|---|---|
| 3,383,212 | 5/1968 | MacLachlan | 96/90 R |
| 3,525,622 | 8/1970 | Willems et al. | 96/139 |
| 3,561,969 | 2/1971 | Burg | 96/90 R |
| 3,567,453 | 3/1971 | Borden | 96/91 R |
| 3,622,341 | 11/1971 | Lee | 96/1.6 |
| 3,623,865 | 11/1971 | Case | 96/88 |
| 3,655,383 | 4/1972 | Shepard et al. | 96/48 PD |
| 3,754,914 | 8/1973 | Inoue et al. | 96/90 |
| 3,765,883 | 10/1973 | Endo et al. | 96/90 R |
| 3,856,524 | 12/1974 | Bissonette | 96/48 R |
| 3,867,144 | 2/1975 | Lee | 96/1.6 |
| 4,045,221 | 8/1977 | DoMinh | 430/936 |
| 4,075,019 | 2/1978 | DoMinh | 430/936 |

FOREIGN PATENT DOCUMENTS

| | | | |
|---|---|---|---|
| 908299 | 10/1962 | United Kingdom | 96/48 |

OTHER PUBLICATIONS

DoMinh, "A Novel Gain Imaging Process", Unconventional Photographic Systems, Symposium IV, 11/20/1975.

Endicott, J. F., et al., J. Am. Chem. Soc., 87, pp. 3348–3357, 8/1965.

Lalor, G. C., J. Inorganic Nuclear Chem. 30, pp. 1783–1789, 1969.

Color Index, 3rd Ed., vol. 4, Society of Dyers and Colorists, 1971, pp. 4020, 4049, 4051, 4064.

*Primary Examiner*—Charles L. Bowers, Jr.

*Attorney, Agent, or Firm*—Dana M. Schmidt

[57] ABSTRACT

An image-forming element is disclosed comprised of a support and a coating thereon containing a cobalt(III)-complex and a compound containing a conjugated $\pi$ bonding system capable of forming at least a bidentate chelate with cobalt(III). The coating is predominantly free of anions which will form conjugate acids by deprotonation of a cobalt(II)complex containing the chelating compound. In one preferred form the image-forming element is radiation-sensitive. In this form the image-forming element can contain a photoactivator capable of initiating reduction of the cobalt(III)complex. An imaging process is disclosed in which the coating is exposed to actinic radiation to produce an image. Images can be recorded directly within the image-forming coating or in a separate image-recording element or layer by use of the residual cobalt(III)complex or by use of one or more of the reaction products produced by exposure. By using the ammonia liberated from ammine ligand containing cobalt(III)complexes on exposure in combination with imagewise and uniform exposures, positive or negative images can be formed in diazo image-recording layers or elements associated with the image-forming coating.

12 Claims, 8 Drawing Figures

IMAGE FORMING COMPOSITION AND ELEMENTS WITH CO(III) COMPLEX, CONJUGATED $\pi$ BONDING COMPOUNDS AND PHOTOREDUCTANT

RELATION TO OTHER APPLICATIONS

This is a division of application Ser. No. 627,416, filed Oct. 30, 1975, now U.S. Pat. No. 4,075,019 which application is a continuation-in-part application of U.S. Ser. No. 461,172 filed Apr. 15, 1974, now abandoned.

This invention is directed to an image-forming element and to a process for its use in which a complex of cobalt(III) and a chelating compound can be formed to achieve imaging by a reaction sequence exhibiting a gain capability. In a specific form this invention is directed to an image-forming element and process which employs a photoactivator to initiate formation of the chelating compound containing cobalt(III)complex. In a further aspect this invention is concerned with such a photographic element and process capable of forming a photographic image in either a photographic element or layer in which the chelating compound containing cobalt(III)complex is formed or in a separate image recording element or layer.

Classically, photographic elements have incorporated silver halide as a radiation-sensitive material. Upon exposure and processing the silver is reduced to its metallic form to produce an image. Processing, with its successive aqueous baths, has become increasingly objectionable to users desiring more immediate availability of a photographic image. Despite the processing required, silver halide photography has remained popular, since it offers a number of distinct advantages. For example, although silver halide is itself photoresponsive only to blue and lower wavelength radiation, spectral sensitizers have been found which, without directly chemically interacting, are capable of transferring higher wavelength radiation energy to silver halide to render it panchromatic. Additionally, silver halide photography is attractive because of its comparatively high speed. Frequently, silver halide is referred to as exhibiting internal amplification—i.e., the number of silver atoms reduced in imaging is a large multiple of the number of photons received.

A variety of nonsilver photographic systems have been considered by those skilled in the art. Typically these systems have been chosen to minimize photographic processing and to provide usable photographic images with less delay than in silver halide photography. Characteristically, these systems require at least one processing step to either print or fix the photographic image. For example, ammonia or heat processing has been widely used in diazo imaging systems. While advantageously simple in terms of processing, these systems have, nevertheless, exhibited significant disadvantages. For example, many nonsilver systems are suitable for producing only negative images (or only positive images). Further, these systems have been quite slow, since they have generally lacked the internal amplification capability of silver halide. Many systems have also suffered from diminishing image-background contrast with the passage of time.

The use of cobalt(III)complex compounds in photographic elements is generally known in the art. For example, Shepard et al U.S. Pat. No. 3,152,903 teaches imaging through the use of an oxidation-reduction reaction system that requires a photocatalyst. The solid reducing agent is taught to be any one of a number of hydroxy aromatic compounds, including dihydrophenols, such as hydroquinone. The oxidant is taught to be chosen from a variety of metals, such as silver, mercury, lead, gold, manganese, nickel, tin, chromium, platinum, and copper. Shepard et al does not specifically teach the use of cobalt(III)complexes as oxidants. Instead, Shepard et al teaches that photochromic complexes, such as cobalt ammines, can be employed as photocatalysts to promote the oxidation-reduction reaction.

Cobalt(III)complexes are known to be directly responsive to electromagnetic radiation when suspended in solution. While most cobalt(III)complexes are preferentially responsive to ultraviolet radiation below about 300 nanometers, a number of cobalt(III)complexes have been observed in solution to be responsive to electromagnetic radiation ranging well into the visible spectrum. Unfortunately, these same complexes when incorporated into photographic elements lose or are diminished in their ability to respond directly to longer wavelength radiation. For example, Hickman et al in U.S. Pat. No. 1,897,843 teaches mixing thio-acetamide with hexamino cobaltic chloride to form a light-sensitive complex capable of interacting with lead acetate to produce a lead sulfide image. Hickman et al U.S. Pat. No. 1,962,307 teaches mixing hexammine cobaltic chloride and citric acid to form a light-sensitive complex capable of bleaching a lead sulfide image. Weyde in U.S. Pat. No. 2,084,420 teaches producing a latent image by exposing $Co(NH_3)_2(NO_2)_4NH_4$ to light or an electrical current. A visible image can be formed by subsequent development with ammonium sulfide.

Borden in U.S. Pat. No. 3,567,453, issued Mar. 2, 1971, and in his article "Review of Light-Sensitive Tetraarylborates", *Photographic Science and Engineering*, Volume 16, No. 4, July-August 1972, discloses that aryl borate salts incorporating a wide variety of cations can be altered in solvent solubility upon exposure to actinic radiation. Borden demonstrates the general utility of aryl borate salts as radiation-sensitive compounds useful in forming differentially developable coatings, as is typical of lithography, by evaluating some 400 different cations ranging from organic cations, such as diazonium, acridinium and pyridinium salts, to inorganic cations, such as cobalt hexammine. Borden discloses that the aryl borate salts can be spectrally sensitized with a variety of sensitizers, including quinones. In its unsensitized form the cobalt hexammine tetraphenyl borate of Borden is reported to be light sensitive in the range of from 290 to 430 nanometers. Borden notes in his report that hexammino cobalt chloride, although bright orange and therefore absorptive in the visible spectrum, is not useful in the lithographic system discussed in his article. Thus, Borden relies upon the light-sensitive aryl borate anionic moiety to provide radiation sensitivity. Further tetraphenyl borate anions have been observed to decompose at pH values of about 6.0 or less.

U.S. Pat. No. 3,754,914 issued to Inoue refers to certain azo dyes, namely p-phenylazodiphenylamine, methyl orange, and dimethylamino azobenzene, as being used in combination with certain reducible cobalt compounds. However, these azo dyes are provided with either no aryl substituents or substituents in the para position, and it is well-known that such substituents will not encourage the necessary chelation, as explained for example in the article "Metal Complexes of Some Azo and Azomethine Dyestuffs" by Anderson, *Anal. Chim. Acta,* 39, (1969), pp. 469–477. The Inoue patent also refers to methyl red, and although this azo dye has an ortho substituent on one aryl group, the dimethyl amine-substituted aryl group lacks a suitable chelating site, such as an ortho substituent.

In U.S. Ser. Nos. 384,858; 384,859; 384,860 and 384,861, all filed Aug. 2, 1973, it is taught to reduce tetrazolium salts and triazolium salts to formazan and azoamine dyes, respectively, employing in the presence of labile hydrogen atoms a photoreductant which is capable of forming a reducing agent precursor upon exposure to actinic radiation. The reducing agent precursor is converted to a reducing agent by a base, such as ammonia. U.S. Ser. No. 384,858 issued on June 3, 1975 as U.S. Pat. No. 3,887,372; U.S. Ser. No. 384,859 issued on June 3, 1975 as U.S. Pat. No. 3,887,374; and U.S. Ser. No. 384,860 issued on Apr. 29, 1975 as U.S. Pat. No. 3,880,659.

In U.S. Ser. Nos. 403,374 (filed Oct. 4, 1973) and 412,082 (filed Oct. 26, 1973) a reducible, image-forming compound is present in a radiation-sensitive layer in combination with a 2H-benzimidazole and a 1,3-diazabicyclo[3.1.0]hex-3-ene (a photochromic aziridine), respectively. Upon exposure the 2H-benzimidazole is converted to a dihydrobenzimidazole reducing agent in radiation-struck areas of the layer. Subsequent heating of the layer fixes the 2H-benzimidazole remaining in non-irradiated areas by converting it to a 1-H-benzimidazole. Upon exposure to actinic radiation the aziridine is converted to a reducing agent precursor. Heating above ambient temperature converts the reducing agent precursor to a reducing agent. The reduction of a cobalt(III)complex is not taught in these patent applications.

SUMMARY OF THE INVENTION

It is an object of this invention to provide an image-forming element and composition for forming said element, such that the element is capable of imagewise forming, without processing, a cobalt(III)complex of a chelating compound by a reaction sequence capable of exhibiting an internal gain. It is a more specific object to provide such elements and processes capable of producing positive and/or negative photographic images either in the image-forming layer or within a separate internal or external imaging layer. It is another object of this invention to provide a photographic elements useful with only thermal processing.

These and other objects of this invention can be achieved in one aspect by providing an image-forming element comprising a support and, as a coating thereon, a layer comprises of a cobalt(III)complex and a compound containing a conjugated $\pi$ bonding system capable of forming at least a bidentate chelate with cobalt(III). The coating is predominantly free of anions which will form conjugate acids by deprotonation of a cobalt(III)complex containing the chelating compound.

In a further aspect, the invention is directed to an image-forming element comprising a support and, as a coating thereon, a layer comprised of a cobalt(III)complex and a compound containing a conjugated $\pi$ bonding system capable of forming at least a bidentate chelate with cobalt(III), the coating being predominantly free of anions of acids having pKa values greater than about 3.5.

Still another aspect of the invention combines with the above-described image-forming element a photoactivator which may be a photoreductant or a spectral sensitizer. Thus, a preferred form of the element and composition is one in which such a photoactivator is present with the cobalt(III)complex and the chelating compound.

In another aspect this invention is directed to a process comprising imagewise exposing to actinic radiation a layer comprised of a cobalt(III)complex and a compound containing a conjugated $\pi$ bonding system capable of forming at least a bidentate chelate with cobalt(III). The coating is predominantly free of anions which will form conjugate acids by deprotonation of a cobalt(II)complex containing the chelating compound. A new complex of cobalt(III) and the chelating compound is then formed in the layer in an imagewise manner.

This invention can be better understood by reference to the following detailed description considered in conjunction with the drawings, in which FIG. 1 is a schematic diagram of a radiation-sensitive element according to this invention;

COBALT(III)COMPLEXES

Figure 1:
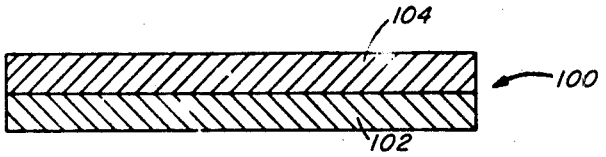

The cobalt(III)complexes employed in the practice of this invention are those which feature a molecule having a cobalt atom or ion surrounded by a group of atoms, ions or other molecules which are generically referred to as ligands. The cobalt atom or ion in the center of these complexes is a Lewis acid while the ligands are Lewis bases. While it is known that cobalt is capable of forming complexes in both its divalent and trivalent forms, trivalent cobalt complexes—i.e., cobalt(III)complexes—are employed in the practice of this invention, since the ligands are tenaciously held in these complexes as compared to corresponding cobalt(II)complexes. Preferred cobalt(III)complexes are those which are inert. Inert complexes are defined as those which, when a test sample thereof is dissolved at 0.1 molar concentration at 20° C. in an inert solvent solution also containing a 0.1 molar concentration of a tagged uncoordinated ligand of the same species as the coordinated ligand, exhibit essentially no exchange of uncoordinated and coordinated ligands for at least one minute, and preferably for at least several hours, such as up to five hours or more. This test is advantageously conducted under the conditions existing within the radiation-sensitive elements of this invention. Many cobalt(III)complexes show essentially no change of uncoordinated or coordinated ligands for several days. The definition of inert complexes, and the method of measuring ligand exchange using radioactive isotopes to tag ligands are well known in the art. See, for example, Taube, *Chem., Rev.*, Vol. 50, p. 69 (1952) and Basolo and Pearson, *Mechanisms of Inorganic Reactions, A Study of Metal Complexes and Solutions*, 2nd Edition, 1967, published by John Wiley and Sons, page 141. Further details on measurement of ligand exchange appear in articles by Adamson et al, *J. Am. Chem.*, Vol. 73, p. 4789 (1951).

Preferred cobalt(III)complexes useful in the practice of this invention are those having a coordination number of 6. A wide variety of ligands can be used with cobalt(III) to form cobalt(III)complexes. Nearly all Lewis bases (i.e. substances having an unshared pair of electrons) can be ligands in cobalt(III)complexes. Some typical useful ligands include halides (e.g., chloride, bromide, fluoride), nitrate, nitrite, superoxide, water, amines (e.g., ethylenediamine, n-propylene diamine, diethylenetriamine, triethylenetetraamine, diaminodiacetate, ethylenediaminetetraacetic acid, etc.), ammine, azide, glyoximes, thiocyanate, cyanide, carbonate, and similar ligands, including those referred to on page 44 of Basolo et al, supra. It is also contemplated to employ cobalt(III)complexes incorporating as ligands Schiff bases, such as those disclosed in German OLS Pat. Nos. 2,052,197 and 2,052,198.

The cobalt(III)complex useful in the practice of this invention can be neutral compounds which are entirely free of either anions or cations. The cobalt(III)complexes can also include one or more cations and anions as determined by the charge neutralization rule. Useful cations are those which produce readily solubilizable cobalt(III)complexes, such as alkali and quaternary ammonium cations.

While a variety of anions can be used in the practice of my invention, the requirement, that the image-forming layer must be predominantly free of anions which will form conjugate acids by deprotonation of a cobalt(II)complex containing a chelating compound containing a conjugated $\pi$ bonding system, can be conveniently satisfied by associating with a cationic moiety of a cobalt(III)complex an anion of a relatively strong acid. While the ease with which the above cobalt(II)complexes can be deprotonated can vary somewhat, depending upon the specific choice of chelating compounds, coatings which permit internal gain can be conveniently achieved by employing cobalt(III)complex anions which form acids having a pKa value of 3.5 or less. Where it is intended to initiate reduction of a cobalt(III)complex using a photoactivator, a marked reduction in speed can result from employing anions of acids having low pKa values, such as those exhibiting pKa values of less than −2.0; however, anions forming acids having low pKa values are not detrimental to the formation of images where cobalt(III)complex reduction is initiated by means other than a photoactivator. Generally, where a photoactivator is employed to initiate reduction and the cobalt(III)complex is being relied upon to acidify the image-forming coating, anions of acids having pKa values in the range of from 0 to 3.0 are considered optimum. It is, of course, recognized that the image-forming coating can incorporate mixtures of anions which form acids of both high and low pKa values. While a minor proportion of anions (less than 50% and preferably less than 10%, on a mole basis, based on total anions) can be tolerated which are capable of deprotonating cobalt(II)complexes, provided the majority of anions present are incapable of deprotonating the cobalt(II)complexes containing the chelating compounds, it is generally preferred to maintain the image-forming layer substantially free of anions which will form conjugate acids by deprotonation of a cobalt(II)complex containing the chelating compound.

A large variety of pKa values have been published. Acids useful in forming exemplary preferred anionic moieties of the cobalt(III)complexes of this invention are those having pKa values under 3.5 listed in *Dissociation Constants of Organic Acids in Aqueous Solution* by G. Kortiim, W. Vogel and K. Andrusson (Butterworths, London, 1961). These anionic moieties are recognized to be generally useful with the cationic cobalt(III)complex moieties of this invention.

Exemplary preferred cobalt(III)complexes are set forth below in Table I.

TABLE I

| Exemplary Preferred Cobalt(III) Complexes | |
|---|---|
| C-1 | hexa-ammine cobalt(III) benzilate |
| C-2 | hexa-ammine cobalt(III) thiocyanate |
| C-3 | hexa-ammine cobalt(III) trifluoroacetate |
| C-4 | chloropenta-ammine cobalt(III) perchlorate |
| C-5 | bromopenta-ammine cobalt(III) perchlorate |
| C-6 | aquopenta-ammine cobalt(III) perchlorate |
| C-7 | bis(ethylenediamine) bisazido cobalt-(III) perchlorate |
| C-8 | bis(ethylenediamine) diacetato cobalt-(III) trifluoroacetate |
| C-9 | triethylenetetramine dichloro cobalt(III) trifluoroacetate |
| C-10 | bis(methylamine) tetra-ammine cobalt(III) hexafluorophosphate |
| C-11 | aquopenta(methylamine) cobalt(III) nitrate |
| C-12 | chloropenta(ethylamine) cobalt(III) perfluorobutanoate |
| C-13 | trinitrotris-ammine cobalt(III) |
| C-14 | trinitrotris(methylamine) cobalt(III) |
| C-15 | tris(ethylenediamine) cobalt(III) perchlorate |
| C-16 | tris(1,3-propanediamine) cobalt(III) tri-fluoroacetate |
| C-17 | bis(dimethylglyoxime) bispyridine cobalt-(III) trichloroacetate |
| C-18 | N,N'-ethylenebis(salicyclideneimine) bis-ammine cobalt(III) perchloroate |
| C-19 | bis(dimethylglyoxime) ethylaquo cobalt-(III) |
| C-20 | $\mu$-superoxodeca-ammine dicobalt(III) perchlorate |
| C-21 | cobalt(III)tris(acetylacetonate) |
| C-22 | penta-ammine carbonato cobalt(III) perchlorate |
| C-23 | tris(glycinato) cobalt(III) |
| C-24 | trans[bis(ethylenediamine) chlorothio-cyanato cobalt(III)] perchlorate |
| C-25 | trans[bis(ethylenediamine) diazido cobalt(III)] thiocyanate |
| C-26 | cis[ethylenediamine ammine azido cobalt-(III)] trifluoroacetate |
| C-27 | tris(ethylenediamine) cobalt(III) benzilate |
| C-28 | trans[bis(ethylenediamine) dichloro cobalt(III)] perchlorate |
| C-29 | bis(ethylenediamine) dithiocyanato cobalt(III) perfluorobenzoate |
| C-30 | triethylenetetramine dinitro cobalt-(III) dichloroacetate |
| C-31 | tris(ethylenediamine) cobalt(III) salicylate |
| C-32 | tris(2,2'-bipyridyl)cobalt(III) perchlorate |
| C-33 | bis(dimethylglyoxime)(chloropyridine) cobalt(III) |
| C-34 | bis(dimethylglyoxime) thiocyanato pyridine cobalt(III) |

Cobalt(III) Chelating Compounds

Any compound containing a conjugated $\pi$ bonding system capable of forming at least a bidentate chelate with cobalt(III) can be employed in the practice of this invention. As is well appreciated by those skilled in the art, conjugated $\pi$ bonding systems can readily be formed by combinations of atoms such as carbon, nitrogen, oxygen and/or sulfur atoms and typically include double bond providing groups, such as vinyl, azo, azinyl, imino, formimidoyl, carbonyl and/or thiocarbonyl groups, in an arrangement that places the double bonds in a conjugated relationship. A variety of compounds are known to the art including a conjugated $\pi$ bonding system capable of forming at least bidentate chelates. Exemplary preferred of such chelating compounds include nitroso-arols, dithiooxamides, formazan, aromatic azo compounds, hydrazones and Schiff bases.

Preferred nitroso-arol chelating compounds are those in which the nitroso and hydroxy substituents are adjacent ring position substituents (e.g., 2-nitrosophenols, 1-nitroso-2-naphthols, 2-nitroso-1-naphthols, etc). Preferred nitroso-arols are those defined by the general formula:

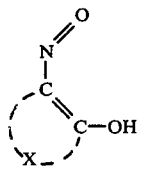

wherein X is comprised of the atoms necessary to complete an aromatic nucleus, typically a phenyl or naphthyl nucleus.

Dithiooxamide is a preferred chelating compound as well as derivatives thereof having one or both nitrogen atoms substituted with an alkyl, alkaryl, aryl, or aralkyl group. Preferred dithiooxamides are those capable of forming tridentate chelates, such as those defined by the formula:

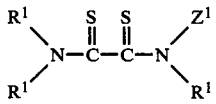

(1)

wherein $Z^1$ is a chelate ligand forming group and $R^1$ is in each instance chosen from among groups such as $Z^1$, hydrogen, alkyl, alkaryl, aryl and aralkyl groups.

Preferred aromatic azo compounds are those capable of forming at least tridentate ligands with cobalt(III). These aromatic azo compounds are defined by the formula:

$$Z^2—N=N—Z^3 \quad (2)$$

wherein $Z^2$ and $Z^3$ are independently chosen aromatic groups, both of which are capable of forming chelate ligands.

Preferred hydrazones capable of forming at least tridentate chelates with cobalt(III) are those of the general formula:

$$Z^4—CH=N—NH—Z^5 \quad (3)$$

wherein $Z^4$ and $Z^5$ are independently chosen aromatic groups, both of which are capable of forming chelate ligands.

Preferred Schiff bases capable of forming at least tridentate chelates with cobalt(III) are those of the general formula:

$$Z^6—CH=N—Z^7 \quad (4)$$

wherein $Z^6$ and $Z^7$ are independently chosen aromatic groups, both of which are capable of forming chelate ligands.

As noted, the groups representing $Z^2$ through $Z^7$ in formulas (2) through (4) above all are capable of chelating. An example of an azo dye which fails to perform the chelation function due to one of the Z groups being incapable of chelating is Orange II.

The aromatic ligand-forming substituents can take the form of either homocyclic or heterocyclic single- or multiple-ring substituents, such as phenyl, naphthyl, anthryl, pyridyl, quinolinyl, thiazolyl, benzothiazolyl, oxazolyl, benzoxazolyl, etc. In one form the aromatic substituent can exhibit a ligand forming capability as a result of being substituted in the ring position adjacent the bonding position with a substituent which is susceptible to forming a ligand, such as a hydroxy, carboxy or amino group. In another form the aromatic substituent can be chosen to be an N-heterocyclic aromatic substituent which contains a ring nitrogen atom adjacent the azo bonding position—e.g., a 2-pyridyl, 2-quinolinyl, 2-thiazolyl, 2-benzothiazolyl, 2-oxazolyl, 2-benzoxazolyl, or similar substituent. The aromatic substituents can, of course, bear substituents which do not interfere with chelating, such as lower alkyl (i.e., one to six carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyano, azido, nitro, haloalkyl (e.g., trifluoromethyl, trifluoroethyl, etc.), amino (e.g., dimethylamino), amido (e.g., acetamido, benzamido), ammonium (e.g., trimethylammonium), azo (e.g., phenylazo), sulfonyl (e.g., methylsulfonyl, phenylsulfonyl), sulfoxy (e.g., methylsulfoxy), sulfonium (e.g., dimethyl sulfonium), silyl (e.g., trimethylsilyl) and thioether (e.g., methylthio substituents. It is generally preferred that the alkyl substituents and substituent moieties of the chelating compounds each have 20 or fewer carbon atoms, most preferably six or fewer carbon atoms. The aryl substituents and substituent moieties of the chelating compounds each are preferably phenyl or naphthyl groups. Exemplary preferred chelate-forming compounds are set forth in Table II.

TABLE II

| Exemplary Chelate-Forming Compounds | |
|---|---|
| CH-1 | 1-(2-pyridyl)-3-phenyl-5-(2,6-dimethylphenyl)formazan |
| CH-2 | 1-(2-pyridyl)-3-n-hexyl-5-phenyl-2H-formazan |
| CH-3 | 1-(2-pyridyl)-3,5-diphenylformazan |
| CH-4 | 1-(benzothiazol-2-yl)-3,5-diphenyl-2H-formazan |
| CH-5 | 1-(2-pyridyl)-3-phenyl-5-(4-chlorophenyl)formazan |
| CH-6 | 1, 1'-di(thiazol-2-yl)-3,3'-diphenylene-5,5'-diphenylformazan |
| CH-7 | 1,3-dodecyl-5-di(benzothiazol-2-yl)-formazan |
| CH-8 | 1-phenyl-3-(3-chlorophenyl)-5-(benzothiazol-2-yl)formazan |
| CH-9 | 1,3-cyano-5-di(benzothiazol-2-yl)- |

TABLE II-continued

| Exemplary Chelate-Forming Compounds | |
|---|---|
| | formazan |
| CH-10 | 1-phenyl-3-propyl-5-(benzothiazol-2-yl)-formazan |
| CH-11 | 1,3-diphenyl-5-(4,5-dimethylthiazol-2-yl)formazan |
| CH-12 | 1-(2-pyridyl)-3,5-diphenylformazan |
| CH-13 | 1-(2-quinolinyl)-3-(3-nitrophenyl)-5-phenylformazan |
| CH-14 | 1-(2-pyridyl)-3-(4-cyanophenyl)-5-(2-tolyl)formazan |
| CH-15 | 1,3-naphthalene-bis[3-[2-(2-pyridyl)-5-(3,4-dichlorophenyl)formazan]] |
| CH-16 | 1-(2-pyridyl)-5-(4-nitrophenyl)-3-phenylformazan |
| CH-17 | 1-(benzothiazol-2-yl)-3,5-di(4-chlorophenyl)formazan |
| CH-18 | 1-(benzothiazol-2-yl)-3-(4-iodophenyl)-5-(3-nitrophenyl)formazan |
| CH-19 | 1-(benzothiazol-2-yl)-3-(4-cyanophenyl)-5-(2-fluorophenyl)formazan |
| CH-20 | 1-(4,5-dimethylthiazol-2-yl)-3-(bromophenyl)-5-(3-trifluorophenyl)formazan |
| CH-21 | 1-(benzoxazol-2-yl)-3,5-diphenylformazan |
| CH-22 | 1-(benzoxazol-2-yl)-3-phenyl-5-(4-chlorophenyl)formazan |
| CH-23 | 1,3-diphenyl-5-(2-pyridyl)formazan |
| CH-24 | 1-(2,5-dimethylphenyl)-3-phenyl-5-(2-pyridyl)formazan |
| CH-25 | 1-(2-pyridyl)-3-(4-cyanophenyl)-5-(2-tolyl)formazan |
| CH-26 | 1-(2-benzothiazolyl)-3-phenyl-5-(8-quinolyl) formazan |
| CH-27 | 1-(4,5-dimethylthiazol-3-yl)-3-(4-bromophenyl)-5-(3-trifluoromethylphenyl)formazan |
| CH-28 | 1,3-diphenyl-5-(benzothiazol-2-yl)-formazan |
| CH-29 | 1-(benzoxazol-2-yl)-3-phenyl-5-(4-chlorophenyl)formazan |
| CH-30 | 1,3-diphenyl-5-(2-quinolinyl)formazan |
| CH-31 | 2-(hydroxyphenylazo)phenol |
| CH-32 | 1-(2-hydroxyphenylazo)-2-naphthol |
| CH-33 | 1-(2-pyridylazo)-2-naphthol |
| CH-34 | 2-(2-pyridylazo)phenol |
| CH-35 | 4-(2-pyridylazo)resorcinol |
| CH-36 | 1-(2-quinolylazo)-2-naphthol |
| CH-37 | 1-(2-thiazolylazo)-2-naphthol |
| CH-38 | 1-(2-benzothiazolylazo)-2-naphthol |
| CH-39 | 1-(4-nitro-2-thiazolylazo)-2-naphthol |
| CH-40 | 4-(2-thiazolylazo)resorcinol |
| CH-41 | 1-(3,4-dinitro-2-hydroxyphenylazo)-2,5-phenylene-diamine |
| CH-42 | 1-(1-isoquinolylazo)-2-naphthol |
| CH-43 | 2-pyridinecarboxaldehyde-2-pyridylhydrazone |
| CH-44 | 2-pyridinecarboxaldehyde-2-benzothiazolylhydrazone |
| CH-45 | 2-thiazolecarboxaldehyde-2-benzoxazolylhydrazone |
| CH-46 | 2-pyridinecarboxaldehyde-2-quinolylhydrazone |
| CH-47 | 1-(2-pyridinecarboxaldehyde-imino)-2-naphthol |
| CH-48 | 1-(2-quinolinecarboxaldehyde-imino)-2-naphthol |
| CH-49 | 1-(2-thiazolecarboxaldehyde-imino)-2-naphthol |
| CH-50 | 1-(2-benzoxazolcarboxaldehyde-imino)-2-phenol |
| CH-51 | 1-(2-pyridine carboxaldehyde-imino)-2-phenol |
| CH-52 | 1-(2-pyridinecarboxaldehyde-imino)-2-pyridine |
| CH-53 | 1-(2-pyridinecarboxaldehyde-imino)-2-quinoline |
| CH-54 | 1-(4-nitro-2-pyridinecarboxaldehyde-imino)-2-thiazole |
| CH-55 | 1-(2-benoxazolecarboxaldehyde-imino)-2-oxazole |
| CH-56 | 1-nitroso-2-naphthol |

TABLE II-continued

| Exemplary Chelate-Forming Compounds | |
|---|---|
| CH-57 | 2-nitroso-1-naphthol |
| CH-58 | 1-nitroso-3,6-disulfo-2-naphthol |
| CH-59 | disodium 1-nitroso-2-naphthol-3,6-disulfonate |
| CH-60 | 4-nitrosoresorcinol |
| CH-61 | 2-nitroso-4-methoxyphenol |
| CH-62 | N-(2-pyridyl)-dithiooxamide |
| CH-63 | N,N'-di(2-pyridyl)dithiooxamide |
| CH-64 | N-(2-benzothiazolyl)dithiooxamide |
| CH-65 | N-(2-quinolinyl)dithiooxamide |
| CH-66 | N,N-dimethyl-dithiooxamide |
| CH-67 | dithiooxamide |

Photoactivators

In order to initiate reduction of the cobalt(III)complex in response to actinic radiation above about 300 nanometers in wavelength it is preferred to incorporate into the image-forming coating a photoactivator. In one form the photoactivator can be a spectral sensitizer as disclosed in, commonly assigned patent application Ser. No. 461,171, filed Apr. 15, 1974 titled SPECTRAL SENSITIZATION OF TRANSITION METAL COMPLEXES, now abandoned. In an alternative form the photoactivator can be a photoreductant of the type disclosed in copending U.S. Ser. Nos. 384,858; 384,859; 384,860; 384,861; 403,374 or 412,082, noted above, or as disclosed in commonly assigned patent application Ser. No. 461,057, filed Apr. 15, 1974 titled TRANSITION METAL PHOTOREDUCTION SYSTEMS AND PROCESSES.

Spectral Sensitizers

Certain relationships preferably should be satisfied for a compound to perform as a spectral sensitizer in this invention. First, the spectral sensitizer must be chosen to exhibit a ground state oxidation potential that is unfavorable for the reduction of the cobalt(III)complex. This relationship is necessary to avoid the spontaneous reduction of the cobalt(III)complex in the absence of actinic radiation. It is generally preferred that the ground state oxidation potential of the spectral sensitizer be related to the reduction potential of the cobalt(III)complex such that for an electron to be transferred from the spectral sensitizer to the cobalt(III)complex it must exhibit a net energy gain. The adverse energy gradient then insures against reduction of the cobalt(III)complex in the absence of externally supplied energy.

The spectral sensitizers, are, or course, chosen to reverse the energy gradient relationship upon exposure to actinic radiation. That it, the spectral sensitizers are chosen to be capable of absorbing radiation having a wavelength longer than 300 nanometers. The absorbed radiant energy then converts the spectral sensitizer to an excited state favorable for reduction of a cobalt(III)complex. In other words, the energy gradient between the excited spectral sensitizer and cobalt(III)complex is reversed by irradiation so that if an electron is transferred from the excited spectral sensitizer to the cobalt(III)complex, it exhibits a net energy loss. Thus, a favorable energy gradient for reduction of the cobalt(III)complex is provided.

The required energy relationships can be satisfied by employing in combination a cobalt(III)complex which exhibits a reduction potential intermediate the ground state oxidation and reduction potentials of the spectral sensitizer, with the further provision, in the case of reversibly reducible complexes, that the reduction potential of the cobalt(III)complex more nearly approach the ground state oxidation potential than the ground state reduction potential of the spectral sensitizer. While it is difficult to measure accurately the excited state oxidation potentials of spectral sensitizers, it is known that upon excitation the oxidation potential of the spectral sensitizer approaches its ground state reduction potential. This then reverses the energy gradient between the spectral sensitizer and the cobalt(III)complex. Another advantage of this relationship is that by choosing the potential difference between the reduction potential of the cobalt(III)complex and the ground state reduction potential of the spectral sensitizer to be large as compared to the potential difference between the ground state oxidation potential of the spectral sensitizer and the reduction potential of the cationic cobalt(III)complex, a more favorable energy gradient is obtained for electron transfer to the cobalt(III)complex from the excited spectral sensitizer than for re-transfer of an electron back to the oxidized spectral sensitizer at its ground state. This relationship is particularly pertinent where the cobalt(III)complex reduction reaction is readily reversed. It is, of course, recognized that in a number of cationic cobalt(III)complexes reduction generates cobalt(II) species with concomittant ligand release. Reversal of the reaction is not then possible, and the available potential gradient for regeneration of the cobalt(III)complex is of no consequence. It is therefore preferred to employ cobalt(III)complexes having at least two monodentate ligands, such as ammine ligands.

Both the cobalt(III)complexes and the spectral sensitizers employed in the practice of this invention can be neutral compounds lacking ionizable components. Since it is important that the spectral sensitizer and cobalt(III)complex be intimately associated, I prefer to employ cationic cobalt(III)complexes in combination with spectral sensitizers bearing a negative charge. In one form the negatively charged spectral sensitizer can even be incorporated into the cobalt(III)complex as an anionic moiety associated with a cationic cobalt(III)complex. Enhanced spectral sensitization has been obtained where the negative charge site is located in the vicinity of the chromophore of the spectral sensitizer. The negative charge site can be vicinally located either by being located within a few bond lengths of the chromophore (preferably within five bond lengths) or by the steric configuration of the molecule. Generally negative charge sites have been incorporated into spectral sensitizers by those skilled in the art through the incorporation of ionizable oxy or sulfur substituents, such as hydroxy, carboxy, sulfonic acid, mercapto and similar substituents. Any one of these charge site providing substituents can be employed in the practice of this invention.

Preferred spectral sensitizers for use in the practice of this invention are those having an anodic polarographic half-wave potential (also referred to as a ground state oxidation potential) which is less than one volt. It is further preferred that the spectral sensitizers be chosen so that the sum of the cathodic polarographic half-wave potential (also referred to as a ground state reduction potential) and the anodic polarographic half-wave potential is more negative than −0.50 volt.

As used herein and in the claims, polarographic measurements are made in accordance with the following procedure. Cathodic polarographic half-wave values are obtained against an aqueous silver-silver chloride reference electrode for the electrochemical reduction of the test compound using controlled-potential polarographic techniques. A $1\times10^{-4}$ M methanol solution of the test compound is prepared. The solvent is 100 percent methanol, if the compound is soluble therein. In some instances, it is necessary to use mixtures of methanol and another solvent, e.g., water, acetone, dimethylformamide, etc., to prepare the $1\times10^{-4}$ M solution of the test compound. There is present in the test solution, as supporting electrolyte, 0.1 M lithium chloride. Only the most positive (least negative) half-wave potential value observed is considered, and it is designated herein as the ground state reduction potential (or simply the reduction potential). Anodic half-wave values are determined against an aqueous silver-silver chloride reference electrode for the electrochemical oxidation of the tested compounds at a pyrolytic graphite electrode, and are obtained by controlled-potential voltammetry using solutions identical to those used to determine the cathodic polarographic values. Only the most negative (least positive) half-wave potential observed is utilized, and it is designated herein as the ground state oxidation potential. In both measurements, the reference electrode (aqueous silver-silver chloride) is maintained at 20° C. Signs are given according to the recommendation of IUPAC at the Stockholm Convention, 1953. The well known general principles of polarographic measurements are used. See Kolthoff and Lingane, "polarography" second edition, Interscience Publishers, New York (1952). The principles of controlled-potential electrochemical instrumentation which allows precise measurements in solvents of low conductivity is described by Kelley, Jones and Fisher, *Anal. Chem.*, 31, 1475 (1959). The theory of potential sweep voltammetry such as that employed in obtaining the anodic determinations is described by Delahay, "New Instrumental Methods in Electrochemistry" Interscience Publishers, New York (1954) and Nicholson and Shain, *Anal. Chem.*, 36, 706 (1964). Information concerning the utility and characteristics of the pyrolytic graphite electrode is described by Chuang, Fried and Elving, *Anal. Chem.*, 36, (1964). It should be noted that the spectral sensitizers and cobalt(III)complexes operable in this invention include those which contain oxidizable ions, such as iodide. For example, many tested compounds which are iodide salts are useful herein. However, the polarographic measurements referred to above cannot be determined in the presence of oxidizable ions. Therefore, such compounds are converted, just for purposes of making polarographic determinations, to an anion such as chloride or p-toluenesulfonate, which do not interfere in making accurate polarographic measurements. Hence, compounds containing oxidizable ions are included within the scope of the useful compounds defined herein and in the claims.

The spectral sensitizers can take the form of sensitizing dyes such as acridines, anthrones, azomethines, cyanines, merocyanines, styryl and styryl base dyes, polycyclic hydrocarbon dyes, ketone dyes, nitro dyes, oxonols (including hemi-oxonols), sulfur dyes, triphenylmethane dyes, xanthene dyes, etc.

Cyanine dyes have been found to be particularly advantageous. The term "cyanine dye", as used herein, is to be construed broadly as inclusive of simple cyanines, carbocyanines, dicarbocyanines, tricarbocyanines, rhodacyanines, etc. Cyanine dyes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups and can be fused to carbocyclic or heterocyclic ring systems either unsubstituted or substituted with halogen, phenyl, alkyl, haloalkyl, cyano, or alkoxy groups. The cyanine dyes can be symmetrical or unsymmetrical and can contain alkyl, phenyl, enamine or heterocyclic substituents on the methine or polymethine chain. Cyanine dyes include complex(tri- or tetra-nuclear) cyanines.

Merocyanine dyes can be employed which are generally comparable to the cyanine dyes discussed above. The merocyanine dyes can contain the basic nuclei noted above as well as acid nuclei such as thiohydantoins, rhodanines, oxazolidenediones, thiazolidenediones, barbituric acids, thiazolineones, and malononitriles. These acid nuclei can be substituted with alkyl, alkylene, phenyl, carboxyalkyl, sulfoalkyl, hydroxyalkyl, alkoxyalkyl, alkylamino groups or heterocyclic nuclei.

As examples of useful spectral sensitizers in addition to the above-described sensitizing dyes, conventional optical brighteners which otherwise satisfy the criteria of this invention can be employed to spectrally sensitize cobalt(III)complexes. Exemplary categories of known optical brighteners useful in sensitizing cobalt(III)complexes include stilbenes, triazenes, fluoresceins, naphthylene sulfonates, oxazoles and coumarins. Particularly preferred optical brighteners useful in the practice of this invention are bis-triazinylaminostilbenes, particularly bis-triazinylaminostilbene disulfonates. Exemplary preferred sensitizers of this type are disclosed in U.S. Pat. Nos. 2,875,058; 3,012,971 and 3,025,242.

In addition to the foregoing, it has been observed that hematoporphyrin acts as a spectral sensitizer for cobalt(III)complexes. For example, it has been observed that hexa-ammine cobalt(III) can be selectively spectrally sensitized to the red portion of the visible spectrum employing hematoporphyrin as a spectral sensitizer.

Exemplary spectral sensitizers preferred for use in the practice of this invention are set forth in Table III.

TABLE III

Exemplary Preferred Spectral Sensitizers

| | Ground State Potentials (volts) | |
|---|---|---|
| | Oxidation | Reduction |
| SS-1 | +0.58 | −1.11 |
| 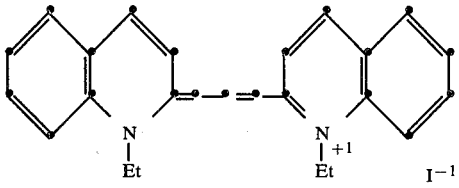 | | |
| 1,1'-diethyl-2,2'-carbocyanine iodide | | |
| SS-2 | +0.27 | −0.98 |
| 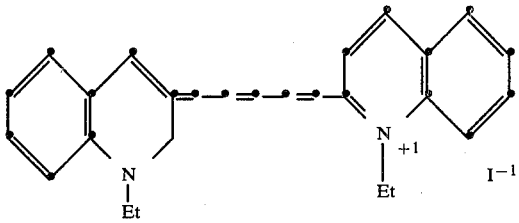 | | |
| 1,1'-diethyl-2,2'-dicarbocyanine iodide | | |
| SS-3 | +0.40 | −1.03 |
| 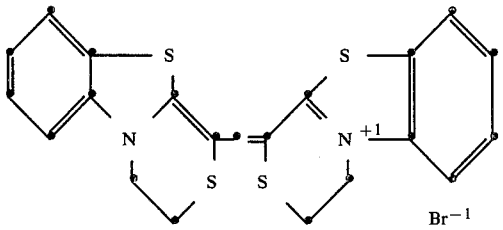 | | |
| 1,1',2,2'-tetrahydro(4H-[1,4]thiazino-[3,4-b]benzothiazolo)cyanine bromide | | |
| SS-4 | +0.5 | −1.4 |
| 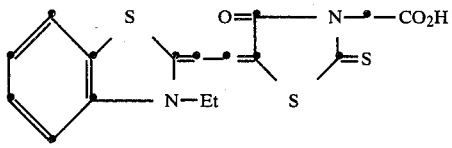 | | |
| 3-carboxymethyl-5-[(3-ethyl-2-benzothiazolinylidene)ethylidene]rhodanine | | |
| SS-5 | +0.37 | −1.16 |

TABLE III-continued

Exemplary Preferred Spectral Sensitizers

| | Ground State Potentials (volts) | |
|---|---|---|
| | Oxidation | Reduction |
| 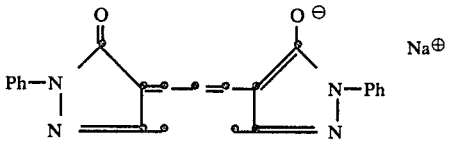 bis [3-methyl-1-phenyl-2-pyrazoline-5-one-(4)]trimethinoxonol, sodium salt SS-6 | +0.27 | −1.1 |
| 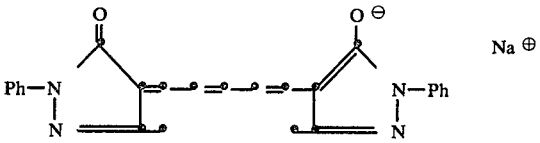 bis[3-methyl-1-phenyl-2-pyrazoline-5-one-(4)]pentamethinoxonol, sodium salt SS-7 | +0.5 | −1.2 |
| 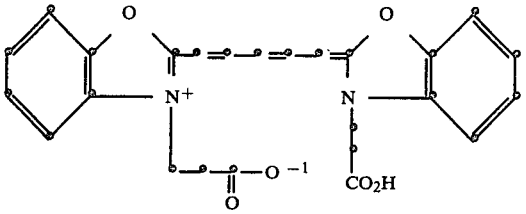 anhydro-3,3'-di(2-carboxyethyl)-oxadicarbocyanine hydroxide SS-8 | +0.6 | −1.26 |
| 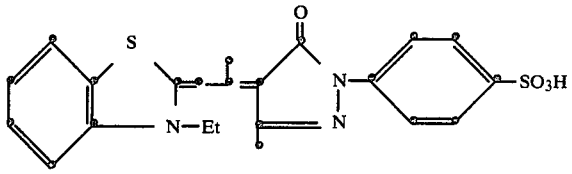 4-[(3-ethyl-2-benzothiazolinylidene)-isopropylidene]-3-methyl-1-(p-sulfophenyl)-2-pyrazoline-5-one SS-9 | +0.48 | −1.31 |
| 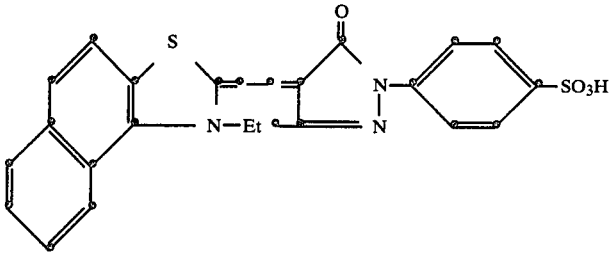 4-[(1-ethyl-2-naphtho[1,2-d]thiazolinylidene)-ethylidene]-3-methyl-1-(p-sulfophenyl)-2-pyrazoline-5-one SS-10 | +0.56 | −1.16 |
| 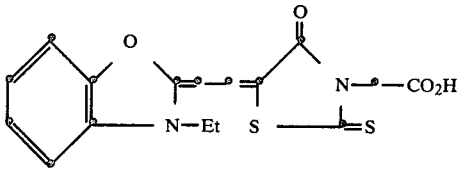 3-carboxymethyl-5-[(3-ethyl-2-benzoxazolinylidene)-ethylidene]rhodanine SS-11 | +.63 | −1.48 |

TABLE III-continued

| Exemplary Preferred Spectral Sensitizers | Ground State Potentials (volts) Oxidation | Reduction |
|---|---|---|
| 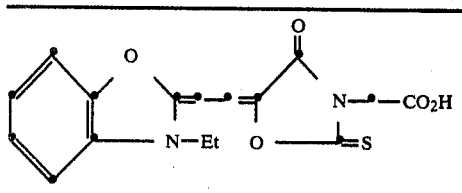 3-carboxymethyl-5-[(3-ethyl-2-benzoxazolinylidene)-ethylidene]-2-thio-2,4-oxazolidenedione SS-12 | +.33 | −1.47 |
| 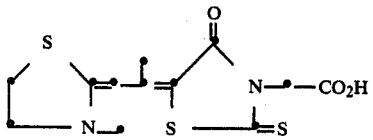 3-carboxymethyl-5-[(3-methyl-2-thiazolidinylidene)-isopropylidene]rhodanine SS-13 | +.28 | −1.50 |
| 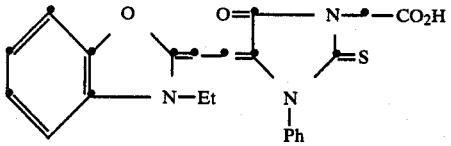 1-carboxymethyl-4-[(3-ethyl-2-benzoxazolinylidene)-ethylidene-3-phenyl-2-thiohydantoin SS-14 | +.42 | −1.70 |
| 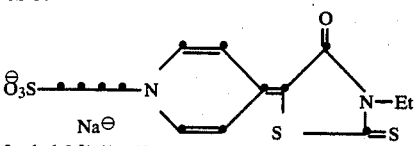 3-ethyl-5-[1-(4-sulfobutyl)-4(1H)-pyridylidene]rhodanine sodium salt SS-15 | +.89 | −1.76 |
| 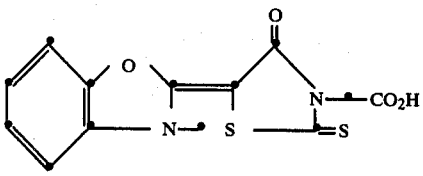 3-carboxymethyl-5-(3-methyl-2-benzoxazolinylidene)rhodanine SS-16 | +.56 | −1.68 |
| 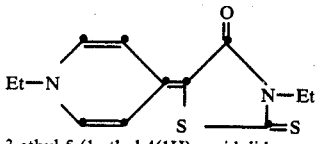 3-ethyl-5-(1-ethyl-4(1H)-pyridylidene rhodanine SS-17 | +0.60 | −1.3 |
| 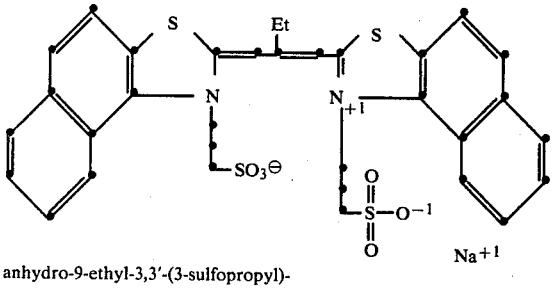 anhydro-9-ethyl-3,3'-(3-sulfopropyl)- | | |

TABLE III-continued

| Exemplary Preferred Spectral Sensitizers | Ground State Potentials (volts) Oxidation | Reduction |
|---|---|---|
| 4,5,4',5'-dibenzothiacarbocyanine hydroxide, sodium salt<br>SS-18 | +0.60 | −1.37 |
| 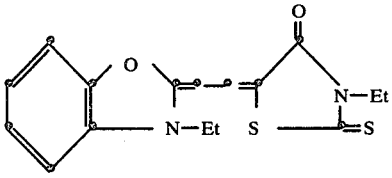 | | |
| 3-ethyl-5-[(3-ethyl-2-benzoxazolinylidene)-ethylidene]rhodanine<br>SS-19 | +0.57 | −1.27 |
| 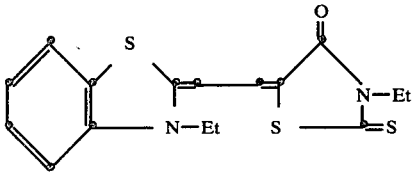 | | |
| 3-ethyl-5-[(3-ethyl-2-benzothiazolinylidene)-ethylidene]rhodanine<br>SS-20 | +0.58 | −1.50 |
| 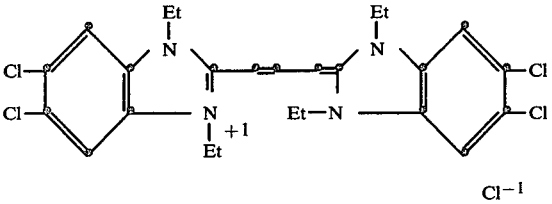 | | |
| 5,5',6,6'-tetrachloro-1,1',3,3'-tetraethyl-benzimidazolo carbocyanine chloride<br>SS-21 | +0.73 | −1.28 |
| 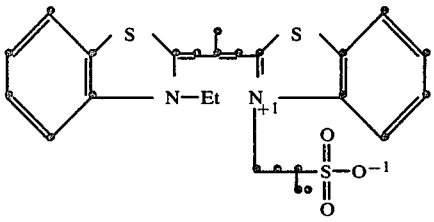 | | |
| anhydro-3-ethyl-9-methyl-3'-(3-sulfobutyl)-thiacarbocyanine hydroxide<br>SS-22 | +0.72 | −1.28 |
| 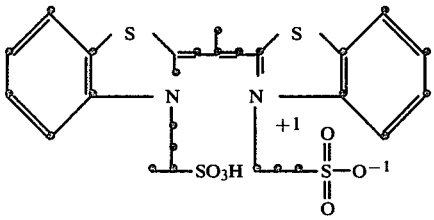 | | |
| anhydro-9-methyl-3,3'-di(3-sulfobutyl)-thiacarbocyanine hydroxide<br>SS-23 | +0.49 | −1.47 |
| 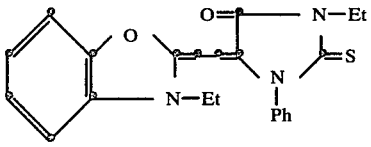 | | |
| 3-ethyl-5-[(3-ethyl-2-benzoxazolinylidene)-ethylidene]-1-phenyl- 2-thiohydantoin<br>SS-24 | +0.63 | −1.14 |

TABLE III-continued

| Exemplary Preferred Spectral Sensitizers | Ground State Potentials (volts) Oxidation | Reduction |
|---|---|---|
| 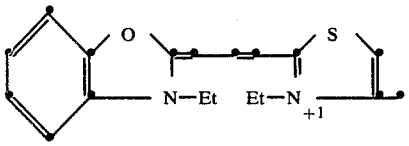 3,3'-diethyl-4'methyloxathiazolo-carbocyanine bromide SS-25 | +0.64 | −1.54 |
| 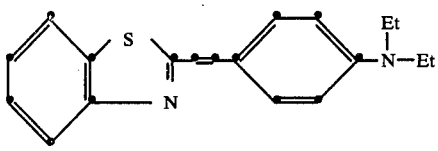 2-p-diethylaminostyrylbenzothiazole SS-26 | +0.87 | −1.06 |
| 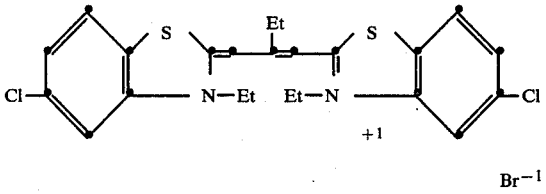 5,5'-dichloro-3,3'-9-triethylthiacarbo-cyanine bromide SS-27 | +0.86 | −1.15 |
| 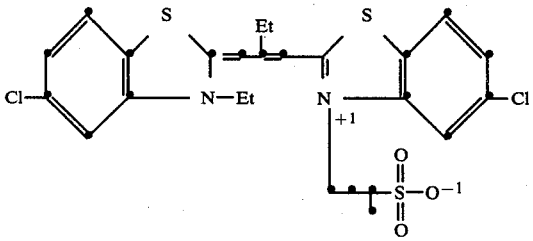 anhydro-5,5'-dichloro-3,9-diethyl-3'-(3-sulfobutyl) thiacarbocyanine hydroxide SS-28 | +0.51 | −1.48 |
| 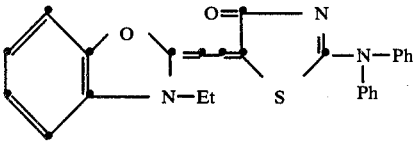 2-diphenylamino-5-[(3-ethyl-2-benzoxazolinyl-idene)ethylene]-2-thiazolin-4-one SS-29 | +0.46 | −1.36 |
| 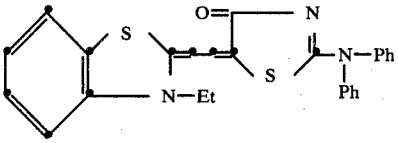 2-diphenylamino-5-[(3-ethyl-2-benzothiazolinyl-idene)ethylidene]-2-thiazolin-4-one SS-30 | | |

TABLE III-continued

Exemplary Preferred Spectral Sensitizers

| | Ground State Potentials (volts) | |
|---|---|---|
| | Oxidation | Reduction |
| 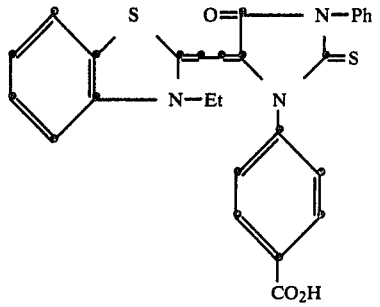 1-p-carboxyphenyl-5-[(3-ethyl-2-benzoxazolinylidene)-ethylidene]-3-phenyl-2-thiohydantoin SS-31 | | |
| 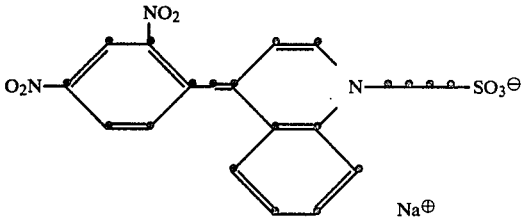 4-(2,4-dinitrobenzylidene)-1,4-dihydro-1-(4-sulfobutyl)quinoline, sodium salt SS-32 | | |
| 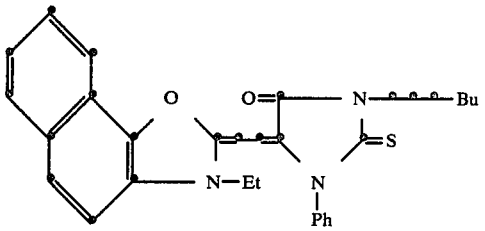 5-[(3-ethylnaphth[2,1-d]oxazolin-2-ylidene)-ethylidene]-3-heptyl-1-phenyl-2-thiohydantoin SS-33 | +0.21 | −1.22 |
| 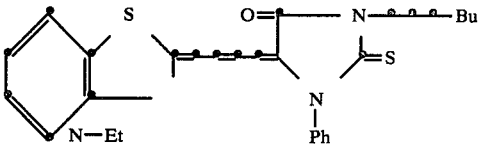 5-[4-(3-ethyl-2-benzothiazolinylidene)-2-butenylidene]-3-heptyl-1-phenyl-2-thiohydantoin SS-34 | +0.63 | −1.29 |
| 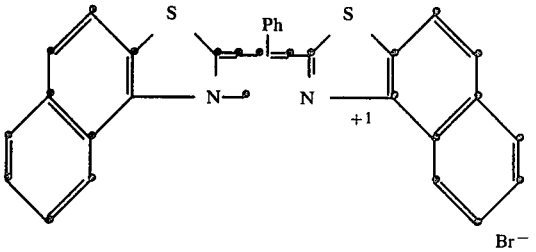 3,3'-dimethyl-9-phenyl-4,5-4'-5'-dibenzothiacarbocyanine bromide SS-35 | +0.8 | more negative than −1.90 |

TABLE III-continued

Exemplary Preferred Spectral Sensitizers

| | Ground State Potentials (volts) | |
|---|---|---|
| | Oxidation | Reduction |
| 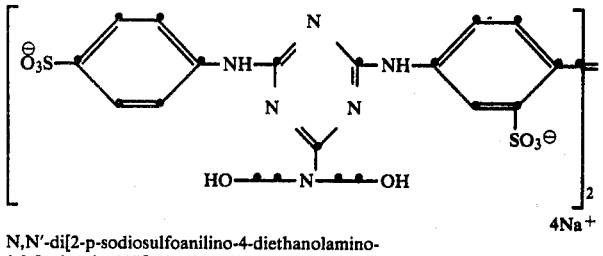 N,N'-di[2-p-sodiosulfoanilino-4-diethanolamino-1,3,5-triazyinyl(6)]-diaminostilbene-2,2'-disulfonic acid, sodium salt SS-36 | +0.83 | more negative than −1.90 |
| 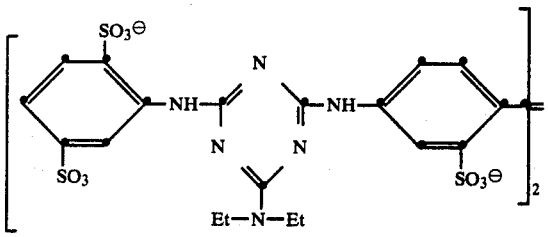 N,N'-di[4-diethylamino-6-(2,5-disulfoanilino)]-2-s-triazinylamino-2,2'-stilbene disulfonic acid, hexasodium salt SS-37 | | |
| 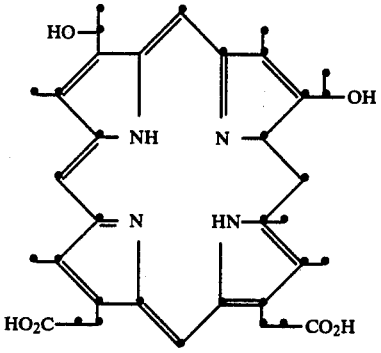 hematoporphyrin SS-38 | | |
| 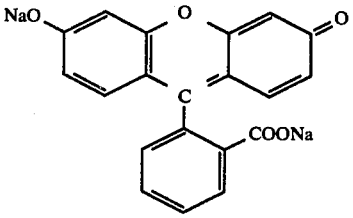 fluorescein disodium salt SS-39 | | |
| 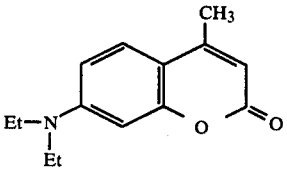 | | |

TABLE III-continued

| Exemplary Preferred Spectral Sensitizers | Ground State Potentials (volts) | |
|---|---|---|
| | Oxidation | Reduction |
| 4-methyl-7-diethylaminocoumarin SS-40 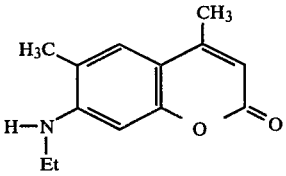 | | |
| 4,6-dimethyl-7-ethylaminocoumarin | | |

• = Carbon atom and sufficient hydrogen atoms, if any to satisfy unspecified bonds
Et = Ethyl group
Ph = Phenyl group
Bu = n-Butyl group

Photoreductants

As employed herein, the term "photoreductant" designates a material capable of molecular photolysis or photo-induced rearrangement to generate a reducing agent, which forms a redox couple with the cobalt(III)-complex. The reducing agent spontaneously or with the application of heat reduces the cobalt(III)complex. The photoreductants employed in the practice of this invention are to be distinguished from spectral sensitizers. While spectral sensitizers may in fact form a redox couple for the reduction of cobalt(III)complexes (although this has not been confirmed), such sensitizers must be associated with the cobalt(III)complex concurrently with receipt of actinic radiation in order for cobalt(III)complex reduction to occur. By contrast, when a photoreductant is first exposed to actinic radiation and thereafter associated with a cobalt(III)complex, reduction of the cobalt(III)complex still occurs.

I have observed quinone, disulfide, diazoanthrone, diazonium salt, diazophenanthrone, aromatic azide, acyloin, aromatic ketone, aromatic carbazide, and diazosulfonate photoreductants to be particularly preferred for use in the practice of this invention.

The disulfide photoreductants employed in this invention are preferably aromatic disulfides containing one or two aromatic groups attached to the sulfur atoms. The aromatic ketones can contain one or two aromatic groups attached to the carbonyl group. The acyloins contain two aromatic groups attached to the

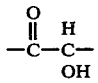

group and one, but not both, hydrogen atoms in the group can be substituted. The nonaromatic groups associated with the aromatic disulfide, aromatic ketone and acyloin photoreductants can take a variety of forms, but are preferably hydrocarbon groups, such as alkyl groups having from 1 to 20 carbon atoms. The alkyl groups preferably have from 1 to 6 carbon atoms, except for the alkyl group associated with the carbonyl group of the aromatic ketone, which preferably has from 6 to 20 carbon atoms. The aromatic groups of the ketone, disulfide, azide, acyloin, carbazide and diazosulfonate photoreductants can be either single or fused carbocyclic aromatic ring structures, such as phenyl, naphthyl, anthryl, etc. They can, alternatively, incorporate heterocyclic aromatic ring structures, such as those having 5- or 6-membered aromatic rings including oxygen, sulfur or nitrogen heteroatoms. The aromatic rings can, of course, bear a variety of substituents. Exemplary of specifically contemplated ring substituents are lower alkyl (i.e., 1 to 6 carbon atoms), lower alkenyl (i.e., 2 to 6 carbon atoms), lower alkynyl (i.e., 2 to 6 carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyano, azido, nitro, haloalkyl (e.g., trifluoromethyl, trifluoroethyl, etc.), amino (e.g., dimethylamino), amido (e.g., acetamido, benzamido), ammonium (e.g., trimethylammonium), azo (e.g., phenylazo), sulfonyl (e.g., methylsulfonyl, phenylsulfonyl), sulfoxy (e.g., methylsulfoxy), sulfonium (e.g., dimethyl sulfonium), silyl (e.g., trimethylsilyl) and thioether (e.g., methyl mercapto) substituents.

Specific exemplary disulfides, diazoanthrones, acyloins, aromatic ketones, diazophenanthrones, aromatic carbazides, aromatic azides, diazonium salts and aromatic diazosulfonates are set forth in Table IV.

TABLE IV

| Exemplary Photoreductants | |
|---|---|
| PR-1 | 1-naphthyl disulfide |
| PR-2 | β-naphthyl disulfide |
| PR-3 | 9-anthryl disulfide |
| PR-4 | cyclohexyl 2-naphthyl disulfide |
| PR-5 | diphenylmethyl 2-naphthyl disulfide |
| PR-6 | 2-dodecyl 1'-naphthyl disulfide |
| PR-7 | thioctic acid |
| PR-8 | 2,2'-bis(hydroxymethyl)diphenyl disulfide |
| PR-9 | 10-diaxoanthrone |
| PR-10 | 2-methoxy-10-diazoanthrone |
| PR-11 | 3-nitro-10-diazoanthrone |
| PR-12 | 3,6-diethoxy-10-diazoanthrone |
| PR-13 | 3-chloro-10-diazoanthrone |
| PR-14 | 4-ethoxy-10-diazoanthrone |
| PR-15 | 4-(1-hydroxyethyl)-10-diazoanthrone |
| PR-16 | 2,7-diethyl-10-diazoanthrone |
| PR-17 | 9-diazo-10-phenanthrone |
| PR-18 | 3,6-dimethyl-9-diazo-10-phenanthrone |
| PR-19 | 2,7-dimethyl-9-diazo-10-phenanthrone |
| PR-20 | 4-azidobenzoic acid |
| PR-21 | 4-nitrophenyl azide |

TABLE IV-continued

| Exemplary Photoreductants | |
|---|---|
| PR-22 | 4-dimethylaminophenyl azide |
| PR-23 | 2,6-di-4-azidobenzylidene-4-methyl-cyclohexanone |
| PR-24 | 2-azido-1-octylcarbamoyl-benzimidazole |
| PR-25 | 2,5-bis(4-azidophenyl)-1,3,4-oxadiazole |
| PR-26 | 1-azido-4-methoxynaphthalene |
| PR-27 | 2-carbazido-2-naphthol |
| PR-28 | benzophenone |
| PR-29 | 2-nitrobenzophenone |
| PR-30 | diaminobenzophenone |
| PR-31 | phthalophenone |
| PR-32 | phenyl(1-methoxybenzyl) ketone |
| PR-33 | phenyl-1-(1-phenoxy)benzyl ketone |
| PR-34 | phenyl-1-(2-chlorophenoxy)benzyl ketone |
| PR-35 | phenyl-1-(4-chlorophenoxy)benzyl ketone |
| PR-36 | phenyl-1-(2-bromophenoxy)benzyl ketone |
| PR-37 | phenyl-1-(2-iodophenoxy)benzyl ketone |
| PR-38 | phenyl-1-(4-phenoxyphenoxy)benzyl ketone |
| PR-39 | phenyl-1-(4-benzoylphenoxy)benzyl ketone |
| PR-40 | 4-(diamylamino)benzenediazonium tetra-fluoroborate |
| PR-41 | 2-methyl-4-diethylaminobenzenediazonium tetrafluoroborate |
| PR-42 | 4-(oxazolidino)benzenediazonium tetra-fluoroborate |
| PR-43 | 4-(cyclohexylamino)benzenediazonium tetra-fluoroborate |
| PR-44 | 2-nitro-4-morpholinobenzenediazonium hexa-fluorophosphate |
| PR-45 | 4-(9-carbazolyl)benzenediazonium hex-fluorophosphate |
| PR-46 | 4-(dihydroxyethylamino)-3-methylbenzene-diazonium hexafluorophosphate |
| PR-47 | 4-diethylaminobenzenediazonium hexa-chlorostannate |
| PR-48 | 4-dimethylamino-3-methylbenzenediazonium hexachlorostannate |
| PR-49 | 2-methyl-4-(N-methyl-N-hydroxypropyl-amino)benzenediazonium hexachlorostannate |
| PR-50 | 4-dimethylaminobenzenediazonium tetra-chlorozincate |
| PR-51 | 4-dimethylamino-3-ethoxybenzenediazonium chlorozincate |
| PR-52 | 4-diethylaminobenzenediazonium tetra-chlorozincate |
| PR-53 | 4-diethylaminobenzenediazonium hexa-fluorophosphate |
| PR-54 | 2-carboxy-4-dimethylaminobenzenediazonium hexafluorophosphate |
| PR-55 | 3-(2-hydroxyethoxy)-4-pyrrolidinobenzene-diazonium hexafluorophosphate |
| PR-56 | 4-methoxybenzenediazonium hexafluoro-phosphate |
| PR-57 | 2,5-diethoxy-4-acetamidobenzenedi-azonium hexafluorophosphate |
| PR-58 | 4-methylamino-3-ethoxy-6-chlorobenzene-diazonium hexafluorophosphate |
| PR-59 | 3-methoxy-4-diethylaminobenzenediazonium hexafluorophosphate |
| PR-60 | di(1-naphthyl) acyloin |
| PR-61 | di(2-naphthyl) acyloin |
| PR-62 | benzoin |
| PR-63 | benzoin acetate |
| PR-64 | benzoin methyl ether |
| PR-65 | benzoin phenyl ether |
| PR-66 | benzoin 2-bromophenyl ether |
| PR-67 | benzoin 4-chlorophenyl ether |
| PR-68 | benzoin 4-phenoxy phenyl ether |
| PR-69 | benzoin 4-benzoylphenyl ether |
| PR-70 | benzoin 2-iodophenyl ether |
| PR-71 | benzoin 2-chlorophenyl ether |
| PR-72 | 2-phenyl benzoin |
| PR-73 | 2-(1-naphthol)benzoin |
| PR-74 | 2-n-butyl benzoin |
| PR-75 | 2-hydroxymethyl benzoin |
| PR-76 | 2-(2-cyanoethyl)benzoin |
| PR-77 | 2-(5-pentynyl)benzoin |

Quinones are useful as photoreductants in the practice of this invention. Preferred quinones include ortho- and para-benzoquinones and ortho- and para-naphthoquinones, phenanthrenequinones and anthraquinones. The quinones may be unsubstituted or incorporate any substituent or combination of substituents that do not interfere with the conversion of the quinone to the corresponding reducing agent. A variety of such substituents are known to the art and include, but are not limited to, primary, secondary and tertiary alkyl, alkenyl and alkynyl, aryl, alkoxy, aryloxy, aralkoxy, alkaryloxy, hydroxyalkyl, hydroxyalkoxy, alkoxyalkyl, acyloxyalkyl, aryloxyalkyl, aroyloxyalkyl, aryloxyalkoxy, alkylcarbonyl, carboxyl, primary and secondary amino, aminoalkyl, amidoalkyl, anilino, piperidino, pyrrolidino, morpholino, nitro, halide and other similar substituents. Such aryl substituents are preferably phenyl substituents and such alkyl, alkenyl and alkynyl substituents, whether present as sole substituents or present in combination with other atoms, typically incorporate 20 (preferably 6) or fewer carbon atoms.

Specific exemplary quinones intended to be used in combination with a separate source of labile hydrogen atoms are set forth in Table V.

TABLE V

| Exemplary Quinones Useful With External Hydrogen Source | |
|---|---|
| PR-78 | 2,5-dimethyl-1,4-benzoquinone |
| PR-79 | 2,6-dimethyl-1,4-benzoquinone |
| PR-80 | duroquinone |
| PR-81 | 2-(1-formyl-1-methylethyl)-5-methyl-1,4-benzoquinone |
| PR-82 | 2-methyl-1,4-benzoquinone |
| PR-83 | 2-phenyl-1,4-benzoquinone |
| PR-84 | 2,5-dimethyl-6-(1-formylethyl)-1,4-benzoquinone |
| PR-85 | 2-(2-cyclohexanonyl)-3,6-dimethyl-1,4-benzoquinone |
| PR-86 | 1,4-naphthoquinone |
| PR-87 | 2-methyl-1,4-naphthoquinone |
| PR-88 | 2,3-dimethyl-1,4-naphthoquinone |
| PR-89 | 2,3-dichloro-1,4-naphthoquinone |
| PR-90 | 2-thiomethyl-1,4-naphthoquinone |
| PR-91 | 2-(1-formyl-2-propyl)-1,4-naphthoquinone |
| PR-92 | 2-(2-benzoylethyl)-1,4-naphthoquinone |
| PR-93 | 9,10-phenanthrenequinone |
| PR-94 | 2-tert-butyl-9,10-anthraquinone |
| PR-95 | 2-methyl-1,4-anthraquinone |
| PR-96 | 2-methyl-9,10-anthraquinone |

A preferred class of photoreductants are internal hydrogen source quinones; that is, quinones incorporating labile hydrogen atoms. These quinones are more easily photoreduced than quinones which do not incorporate labile hydrogen atoms. Even when quinones lacking labile hydrogen atoms are employed in combination with an external source of hydrogen atoms while incorporated hydrogen source quinones are similarly employed without external hydrogen source compounds, the internal hydrogen source quinones continue to exhibit greater ease of photoreduction. When internal hydrogen source quinones are employed with external hydrogen source compounds, their ease of photoreduction can generally be further improved, although the improvement is greater for those internal hydrogen source quinones which are less effective when employed without an external hydrogen source compound.

Using quinones exhibiting greater ease of photoreduction results in photographic elements which exhibit improved image densities for comparable exposures and which produce comparable image densities with lesser exposure times. Hence, internal hydrogen source quinones can be employed to achieve greater photographic speeds and/or image densities.

Particularly preferred internal hydrogen source quinones are 5,8-dihydro-1,4-naphthoquinones having at least one hydrogen atom in each of the 5 and 8 ring positions. Other preferred incorporated hydrogen source quinones are those which have a hydrogen atom bonded to a carbon atom to which is also bonded the oxygen atom of an oxy substituent or a nitrogen atom of an amine substituent with the further provision that the carbon to hydrogen bond is the third or fourth bond removed from at least one quinone carbonyl double bond. As employed herein the term "amine substituent" is inclusive of amide and imine substituents. Disubstituted amino substituents are preferred. 1,4-Benzoquinones and naphthoquinones having one or more 1'- or 2'-hydroxyalkyl, alkoxy (including alkoxyalkoxy—particularly 1'- or 2'-alkoxyalkoxy, hydroxyalkoxy, etc.), 1'- or 2'-alkoxyalkyl, aralkoxy, 1'- or 2'-acyloxyalkyl, 1'- or 2'-aryloxyalkyl, aryloxyalkoxy, 1'- or 2'-aminoalkyl (preferably a 1'- or 2'-aminoalkyl in which the amino group contains two substituents in addition to the alkyl substituent), 1'- or 2'-aroyloxyalkyl, alkylarylamino, dialkylamino, N,N-bis-(1-cyanoalkyl)amino, N-aryl-N-(1-cyanoalkyl)amino, N-alkyl-N-(1-cyanoalkyl)amino, N,N-bis(1-carbalkoxyalkyl)amino, N-aryl-N-(1-carbalkoxyalkyl)amino, N-alkyl-N-(1-carbalkoxyalkyl)amino, N,N-bis(1-nitroalkyl)amino, N-alkyl-N-(1-nitroalkyl-)amino, N-aryl-N-(1-nitroalkyl)amino, N,N-bis-(1-acylalkyl)amino, N-alkyl-N-(1-acylalkyl)amino, N-aryl-N-(1-acylalkyl)amino, pyrrolino, pyrrolidino, piperidino, and/or morpholino substituents in the 2 and/or 3 position are particularly preferred. Other substituents can, of course, be present. Unsubstituted 5,8-dihydro-1,4-naphthoquinone and 5,8-dihydro-1,4-naphthoquinones substituted at least in the 2 and/or 3 position with one or more of the above-listed preferred quinone substituents also constitute preferred internal hydrogen source quinones. It is recognized that additional fused rings can be present within the incorporated hydrogen source quinones. For example, 1,4-dihydro-anthraquinones represent a useful species of 5,8-dihydro-1,4-naphthoquinones useful as incorporated hydrogen source quinones. The aryl substituents and substituent moieties of incorporated hydrogen source quinones are preferably phenyl or phenylene while the aliphatic hydrocarbon substituents and substituent moieties preferably incorporate twenty or fewer carbon atoms and, most preferably, six or fewer carbon atoms. Exemplary preferred internal hydrogen source quinones are set forth in Table VI.

TABLE VI

| Exemplary Internal Hydrogen Source Quinones | |
|---|---|
| PR-97 | 5,8-dihydro-1,4-naphthoquinone |
| PR-98 | 5,8-dihydro-2,5,8-trimethyl-1,4-naphthoquinone |
| PR-99 | 2,5-bis(dimethylamino)-1,4-benzoquinone |
| PR-100 | 2,5-dimethyl-3,6-bis(dimethylamino)-1,4-benzoquinone |
| PR-101 | 2,5-dimethyl-3,6-bispyrrolidino-1,4-benzoquinone |
| PR-102 | 2-ethoxy-5-methyl-1,4-benzoquinone |
| PR-103 | 2,6-dimethoxy-1,4-benzoquinone |
| PR-104 | 2,5-dimethoxy-1,4-benzoquinone |
| PR-105 | 2,6-diethoxy-1,4-benzoquinone |
| PR-106 | 2,5-diethoxy-1,4-benzoquinone |
| PR-107 | 2,5-bis(2-methoxyethoxy)-1,4-benzoquinone |
| PR-108 | 2,5-bis(β-phenoxyethoxy)-1,4-benzoquinone |
| PR-109 | 2,5-diphenethoxy-1,4-benzoquinone |

TABLE VI-continued

| Exemplary Internal Hydrogen Source Quinones | |
|---|---|
| PR-110 | 2,5-di-n-propoxy-1,4-benzoquinone |
| PR-111 | 2,5-di-isopropoxy-1,4-benzoquinone |
| PR-112 | 2,5-di-n-butoxy-1,4-benzoquinone |
| PR-113 | 2,5-di-sec-butoxy-1,4-benzoquinone |
| PR-114 | 1,1'-bis(5-methyl-1,4-benzoquinone-2-yl)-diethyl ether |
| PR-115 | 2-methyl-5-morpholinomethyl-1,4-benzoquinone |
| PR-116 | 2,3,5-trimethyl-6-morpholinomethyl-1,4-benzoquinone |
| PR-117 | 2,5-bis(morpholinomethyl)-1,4-benzoquinone |
| PR-118 | 2-hydroxymethyl-3,5,6-trimethyl-1,4-benzoquinone |
| PR-119 | 2-(1-hydroxyethyl)-5-methyl-1,4-benzoquinone |
| PR-120 | 2-(1-hydroxy-n-propyl)-5-methyl-1,4-benzoquinone |
| PR-121 | 2-(1-hydroxy-2-methyl-n-propyl)-5-methyl-1,4-benzoquinone |
| PR-122 | 2-(1,1-dimethyl-2-hydroxyethyl)-5-methyl-1,4-benzoquinone |
| PR-123 | 2-(1-acetoxyethyl)-5-methyl-1,4-benzoquinone |
| PR-124 | 2-(1-methoxyethyl)-5-methyl-1,4-benzoquinone |
| PR-125 | 2-(2-hydroxyethyl)-3,5,6-trimethyl-1,4-benzoquinone |
| PR-126 | 2-ethoxy-5-phenyl-1,4-benzoquinone |
| PR-127 | 2-i-propoxy-5-phenyl-1,4-benzoquinone |
| PR-128 | 1,4-dihydro-1,4-dimethyl-9,10-anthraquinone |
| PR-129 | 2-dimethylamino-1,4-naphthoquinone |
| PR-130 | 2-methoxy-1,4-naphthoquinone |
| PR-131 | 2-benzyloxy-1,4-naphthoquinone |
| PR-132 | 2-methoxy-3-chloro-1,4-naphthoquinone |
| PR-133 | 2,3-dimethoxy-1,4-naphthoquinone |
| PR-134 | 2,3-diethoxy-1,4-naphthoquinone |
| PR-135 | 2-ethoxy-1,4-naphthoquinone |
| PR-136 | 2-phenethoxy-1,4-naphthoquinone |
| PR-137 | 2-(2-methoxyethoxy)-1,4-naphthoquinone |
| PR-138 | 2-(2-ethoxyethoxy)-1,4-naphthoquinone |
| PR-139 | 2-(2-phenoxy)ethoxy-1,4-naphthoquinone |
| PR-140 | 2-ethoxy-5-methoxy-1,4-naphthoquinone |
| PR-141 | 2-ethoxy-6-methoxy-1,4-naphthoquinone |
| PR-142 | 2-ethoxy-7-methoxy-1,4-naphthoquinone |
| PR-143 | 2-n-propoxy-1,4-naphthoquinone |
| PR-144 | 2-(3-hydroxypropoxy)-1,4-naphthoquinone |
| PR-145 | 2-isopropoxy-1,4-napthoquinone |
| PR-146 | 7-methoxy-2-isopropoxy-1,4-naphthoquinone |
| PR-147 | 2-n-butoxy-1,4-naphthoquinone |
| PR-148 | 2-sec-butoxy-1,4-naphthoquinone |
| PR-149 | 2-n-pentoxy-1,4-naphthoquinone |
| PR-150 | 2-n-hexoxy-1,4-naphthoquinone |
| PR-151 | 2-n-heptoxy-1,4-naphthoquinone |
| PR-152 | 2-acetoxymethyl-3-methyl-1,4-naphthoquinone |
| PR-153 | 2-methoxymethyl-3-methyl-1,4-naphthoquinone |
| PR-154 | 2-(β-acetoxyethyl)-1,4-naphthoquinone |
| PR-155 | 2-N,N-bis(cyanomethyl)aminomethyl-3-methyl-1,4-naphthoquinone |
| PR-156 | 2-methyl-3-morpholinomethyl-1,4-naphthoquinone |
| PR-157 | 2-hydroxymethyl-1,4-naphthoquinone |
| PR-158 | 2-hydroxymethyl-3-methyl-1,4-naphthoquinone |
| PR-159 | 2-(1-hydroxyethyl)-1,4-naphthoquinone |
| PR-160 | 2-(2-hydroxyethyl)-1,4-naphthoquinone |
| PR-161 | 2-(1,1-dimethyl-2-hydroxyethyl)-1,4-naphthoquinone |
| PR-162 | 2-bromo-3-isopropoxy-1,4-naphthoquinone |
| PR-163 | 2-ethoxy-3-methyl-1,4-naphthoquinone |
| PR-164 | 2-chloro-3-piperidino-1,4-naphthoquinone |
| PR-165 | 2-morpholino-1,4-naphthoquinone |
| PR-166 | 2,3-dipiperidino-1,4-naphthoquinone |
| PR-167 | 2-dibenzylamino-3-chloro-1,4-naphthoquinone |
| PR-168 | 2-methyloxycarbonylmethoxy-1,4-naphthoquinone |
| PR-169 | 2-(N-ethyl-N-benzylamino)-3-chloro-1,4-naphthoquinone |

TABLE VI-continued

| Exemplary Internal Hydrogen Source Quinones | |
|---|---|
| PR-170 | 2-morpholino-3-chloro-1,4-naphthoquinone |
| PR-171 | 2-pyrrolidino-3-chloro-1,4-naphthoquinone |
| PR-172 | 2-diethylamino-3-chloro-1,4-naphthoquinone |
| PR-173 | 2-diethylamino-1,4-naphthoquinone |
| PR-174 | 2-piperidino-1,4-naphthoquinone |
| PR-175 | 2-pyrrolidino-1,4-naphthoquinone |
| PR-176 | 2-(2-hexyloxy)-1,4-naphthoquinone |
| PR-177 | 2-neo-pentyloxy-1,4-naphthoquinone |
| PR-178 | 2-(2-n-pentyloxy)-1,4-naphthoquinone |
| PR-179 | 2-(3-methyl-n-butoxy)-1,4-naphthoquinone |
| PR-180 | 2-(6-hydroxy-n-hexoxy)-1,4-naphthoquinone |
| PR-181 | 2-ethoxy-3-chloro-1,4-naphthoquinone |
| PR-182 | 2-di(phenyl)methoxy-1,4-naphthoquinone |
| PR-183 | 2-(2-hydroxyethoxy)-3-chloro-1,4-naphthoquinone |
| PR-184 | 2-methyl-3-(1-hydroxymethyl)ethyl-1,4-naphthoquinone |
| PR-185 | 2-azetidino-3-chloro-1,4-naphthoquinone |
| PR-186 | 2-(2-hydroxyethyl)-3-bromo-1,4-naphthoquinone |
| PR-187 | 2,3-dimorpholino-1,4-naphthoquinone |
| PR-188 | 2-ethylamino-3-piperidino-1,4-naphthoquinone |
| PR-189 | 2-ethoxymethyl-1,4-naphthoquinone |
| PR-190 | 2-phenoxymethyl-1,4-naphthoquinone |

I have also recognized that 2H-benzimidazoles are capable, upon exposure to actinic radiation in the presence of labile hydrogen atoms, of forming dihydrobenzimidazoles, which are reducing agents.

Although it is contemplated that the 2H-benzimidazoles useful in the practice of this invention can include those having electron withdrawing substituents, such as halogen atoms, cyano groups, carboxy groups, nitro groups, carbonyl containing groups and the like, it is preferred to employ 2H-benzimidazoles which incorporate one or more electron donating substituents, since electron donating substituents increase the ease with which the dihydrobenzimidazoles produced from 2H-benzimidazoles on exposure are oxidized. Illustrative of electron donating substituents are hydroxy groups; alkoxy groups; primary, secondary and tertiary amino groups—e.g., amino, alkylamino, dialkylamino, arylamino, diarylamino, aralkylamino, diarlkylamino, morpholino, piperidino, and the like; alkylazo; alkenyl; styryl; and the like. It is generally preferred that the alkyl substituents and substituent moieties have 20 or fewer carbon atoms, most preferably six or fewer carbon atoms. The aryl substituents and substituent moieties are preferably phenyl groups.

Exemplary 2H-benzimidazole photoreductants are set forth below in Table VII.

TABLE VII

| Exemplary 2H-Benzimidazole Photoreductants | |
|---|---|
| PR-191 | 2,2-dimethyl-2H-benzimidazole |
| PR-192 | 2,2-diethyl-2H-benzimidazole |
| PR-193 | 2,2-di-n-hexyl-2H-benzimidazole |
| PR-194 | spiro(2H-benzimidazole-2,1'-cyclohexane) |
| PR-195 | dispiro(2H-benzimidazole-2,1'-cyclohexane-4',2''-2H-benzimidazole) |
| PR-196 | 2,2-dibenzyl-2H-benzimidazole |
| PR-197 | 2,2-diphenyl-2H-benzimidazole |
| PR-198 | 2,2-dimethyl-4-n-butyl-2H-benzimidazole |
| PR-199 | 2,2-diphenyl-5-n-hexyl-2H-benzimidazole |
| PR-200 | 2'-methylspiro(2H-benzimidazole-2,1'-cyclohexane) |
| PR-201 | 3'-methylspiro(2H-benzimidazole-2,1'-cyclohexane) |

TABLE VII-continued

| Exemplary 2H-Benzimidazole Photoreductants | |
|---|---|
| PR-202 | 4'-methylspiro(2H-benzimidazole-2,1'-cyclohexane) |
| PR-203 | 2',6'-dimethylspiro(2H-benzimidazole-2,1'-cyclohexane) |
| PR-204 | 5-methylspiro(2H-benzimidazole-2,1'-cyclohexane) |
| PR-205 | 5,6-dimethylspiro(2H-benzimidazole-2,1'-cyclohexane) |
| PR-206 | 5,5''-dimethyldispiro(2H-benzimidazole-2,1'-cyclohexane-4',2''-2H-benzimidazole) |
| PR-207 | 5,6,5'',6''-tetramethyldispiro(2H-benzimidazole-2,1'-cyclohexane-4',2''-2H-benzimidazole) |
| PR-208 | 4-bromo-2,2-dimethyl-2H-benzimidazole |
| PR-209 | 5-iodo-2,2-dimethyl-2H-benzimidazole |
| PR-210 | 5-chlorospiro(2H-benzimidazole-2,1'-cyclohexane) |
| PR-211 | 4-fluorospiro(2H-benzimidazile-2,1'-cyclohexane) |
| PR-212 | 2,2-diethyl-4-trichloromethyl-2H-benzimidazole |
| PR-213 | 2,2-diphenyl-4-trifluoromethyl-2H-benzimidazole |
| PR-214 | 2',3',4',5',6'-pentachlorospiro(2H-benzimidazole-2,1'-cyclohexane) |
| PR-215 | 5-trifluoromethylspiro(2H-benzimidazole-2,1'-cyclohexane) |
| PR-216 | 2,2-dibenzyl-4-methoxy-2H-benzimidazole |
| PR-217 | 2,2-diethyl-4-isopropoxy-2H-benzimidazole |
| PR-218 | 2,2-diethyl-5-ethoxy-2H-benzimidazole |
| PR-219 | 5-methoxyspiro(2H-benzimidazole-2,1'-cyclohexane) |
| PR-220 | 4-ethoxyspiro(2H-benzimidazole-2,1'-cyclohexane) |
| PT-221 | 5-isopropoxyspiro(2H-benzimidazole-2,1'-cyclohexane) |
| PR-222 | 2'-methoxyspiro(2H-benzimidazole-2,1'-cyclohexane) |
| PR-223 | 3'-neopentoxyspiro(2H-benzimidazole-2,1'-cyclohexane) |
| PR-224 | 4,4'-dimethoxydispiro(2H-benzimidazole-2,1'-cyclohexane-4',2''-2H-benzimidazole) |
| PR-225 | 5,5''-diisopropoxy-2'-methoxydispiro(2H-benzimidazole-2,1'-cyclohexane-4',2''-2H-benzimidazole) |
| PR-226 | 2,2-dimethyl-4-amino-2H-benzimidazole |
| PR-227 | 2,2-dimethyl-4-(N,N-dimethylamino)-2H-benzimidazole |
| PR-228 | 2,2-dimethyl-5-(N-phenylamino)-2H-benzimidazole |
| PR-229 | 2,2-dimethyl-5-(N-tolylamino)-2H-benzimidazole |
| PR-230 | 4-(N,N-diphenylamino)spiro(2H-benzimidazole-2,1'-cyclohexane) |
| PR-231 | 4-(N-phenylamino)spiro(2H-benzimidazole-2,1'-cyclohexane) |
| PR-232 | 2'-morpholinospiro(2H-benzimidazole-2,1'-cyclohexane) |
| PR-233 | 2,2-diphenyl-4-piperidino-2H-benzimidazole |
| PR-234 | 2,2-diphenyl-5-methylazo-2H-benzimidazole |
| PR-235 | 2'-methylazospiro(2H-benzimidazole-2,1'-cyclohexane) |
| Pr-236 | 2,2-dimethyl-5-styryl-2H-benzimidazole |
| PR-237 | 2,2-dimethyl-4-vinyl-2H-benzimidazole |
| PR-238 | 5-vinylspiro(2H-benzimidazole-2,1'-cyclohexane) |
| PR-239 | 2,2-diphenyl-5-nitro-2H-benzimidazole |
| PR-240 | 5-carbomethoxyspiro(2H-benzimidazole-2,1'-cyclohexane) |

I have also recognized the utility of 1,3-diazabicyclo[3.1.0]hex-3-enes as photoreductants capable of forming successively reducing agent precursors and reducing agents upon exposure to actinic radiation and heat.

Since the photoresponse of 1,3-diazabicyclo[3.1.0-]hex-3-enes is primarily a function of the ring structure, any known compound of this type can be used in the practice of this invention. 1,3-diazabicyclo[3.1.0]hex-3-enes are known having various combinations of substituents. Typical of the 1,3-diazabicyclo[3.1.0]hex-3-enes useful in the practice of this invention are those defined by the formula (II)

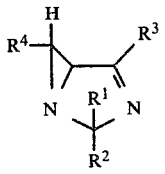

(II)

wherein $R^1$ and $R^2$ are independently chosen from among such substituents as hydrogen, alkyl (including cycloalkyl), aralkyl, alkaryl and aryl substituents or together $R^1$ and $R^2$ constitute an alkylene substituent, preferably forming a 5- or 6-membered ring;

$R^3$ is an aryl or electron withdrawing substituent, such as a cyano group, a carboxy group, a nitro group or a carbonyl-containing group; and $R^4$ is an aryl or alkaryl substituent.

In alternative 1,3-diazabicyclo[3.1.0]hex-3-enes according to this invention the nitrogen atom in ring position 1 (the nitrogen atom common to both rings) can be converted to form the corresponding quaternary salt or N-oxide. When the 1 position nitrogen atom is quaternized it can bear an alkyl or aralkyl substituent or hydrogen. The alkyl and aryl substituents and substituent moieties can be further substituted—e.g., mono- or di-substituted. Typical aryl and alkyl substituents contemplated include alkyl, benzyl, styryl, phenyl, biphenylyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyano, azido, nitro, haloalkyl (e.g., trifluoromethyl, trifluoroethyl, etc.), amino (e.g., dimethylamino), amido (e.g., acetamido, benzamido, etc.), ammonium (e.g., trimethylammonium), azo (e.g., phenylazo), sulfonyl (e.g., methylsulfonyl, phenylsulfonyl), sulfoxy (e.g., methylsulfoxy), sulfonium (e.g., dimethyl sulfonium), silyl (e.g., trimethylsilyl) and thioether (e.g., methylthio) substituents. It is generally preferred that alkyl and alkylene substituents and substituent moieties having 20 or fewer carbon atoms, most preferably six or fewer carbon atoms, be employed. The aryl substituents and substituent moieties are preferably phenyl or naphthyl groups.

Exemplary 1,3-diazabicyclo[3.1.0]hex-3-ene photoreductants are set forth below in Table VIII.

TABLE VIII

| Exemplary 1,3-Diazabicyclo[3.1.0]-hex-3-ene Photoreductants | |
|---|---|
| PR-241 | 4,6-diphenyl-1,3-diazabicyclo[3.1.0]-hex-3-ene |
| PR-242 | 4-phenyl-6-(4-nitrophenyl)-1,3-diazabicyclo[3.1.0]hex-3-ene |
| PR-243 | 2,4,6-triphenyl-1,3-diazabicyclo[3.1.0]-hex-3-ene |
| PR-244 | 2,4-diphenyl-6-(4-nitrophenyl)-1,3-diazabicyclo[3.1.0]hex-3-ene |
| PR-245 | 2,2-dicyclopropyl-4-phenyl-6-(4-nitrophenyl)-1,3-diazabicyclo[3.1.0]-hex-3-ene |
| PR-246 | 2,6-diphenyl-4-cyano-1,3-diazabicyclo-[3.1.0]hex-3-ene |
| PR-247 | 2-(1-naphthyl)-4,6-di-(chlorophenyl)-1,3-diazabicyclo[3.1.0]hex-3-ene |
| PR-248 | 2-methyl-4-phenyl-6-(4-nitrophenyl)-1,3-diazabicyclo[3.1.0]hex-3-ene |
| PR-249 | 2-n-propyl-4-phenyl-6-(4-nitrophenyl)-1,3-diazabicyclo[3.1.0]hex-3-ene |
| PR-250 | 2-iso-propyl-4-phenyl-6-(4-nitrophenyl)-1,3-diazabicyclo[3.1.0]hex-3-ene |
| PR-251 | 2,2-dimethyl-4,6-diphenyl-1,3-diazabicyclo[3.1.0]hex-3-ene |
| PR-252 | 2,2-dimethyl-4-phenyl-6-(4-nitrophenyl)-1,3-diazabicyclo[3.1.0]hex-3-ene |
| PR-253 | 2,2-dimethyl-4-(4-nitrophenyl)-6-phenyl-1,3-diazabicyclo[3.1.0]hex-3-ene |
| PR-254 | 2,2-dimethyl-4-phenyl-6-(4-chlorophenyl)-1,3-diazabicyclo[3.1.0]hex-3-ene |
| PR-255 | 2-methyl-2-ethyl-4-phenyl-6-(4-nitrophenyl)-1,3-diazabicyclo[3.1.0]hex-3-ene |
| PR-256 | 2-methyl-2-n-propyl-4-phenyl-6-(4-nitrophenyl)-1,3-diazobicyclo[3.1.0]hex-3-ene |
| PR-257 | 2-methyl-2-tert-butyl-4-phenyl-6-(4-nitrophenyl)-1,3-diazabicyclo[3.1.0]hex-3-ene |
| PR-258 | 2,4-diphenyl-2-methyl-6-(4-nitrophenyl)-1,3-diazabicyclo[3.1.0]hex-3-ene |
| PR-259 | 2,2-dimethyl-4-phenyl-6-(4-nitrophenyl)-1,3-diazabicyclo[3.1.0]hex-3-ene |
| PR-260 | 2,2-diethyl-4-phenyl-6-(3-nitrophenyl)-1,3-diazabicyclo[3.1.0]hex-3-ene |
| PR-261 | 2,2-di-n-hexyl-4,6-diphenyl-1,3-diazabicyclo[3.1.0]hex-3-ene |
| PR-262 | spiro{cyclopentane-1,2'[4'-phenyl-6'-(4-nitrophenyl)-1',3'-diazabicyclo-[3.1.0]hex-3-ene]} |
| PR-263 | spiro{cyclohexane-1,2'-[4'-phenyl-6'-(4-nitrophenyl)-1',3'-diazabicyclo-[3.1.0]hex-3-ene]} |
| PR-264 | spiro{spiro{cycloheptane-1,2'-[4'-phenyl-6'-(4-nitrophenyl)-1',3'-diazabicyclo-[3.1.0]hex-3-ene]} |
| PR-265 | spiro{cyclooctane-1,2'-[4'-phenyl-6'-(4-nitrophenyl)-1',3'-diazabicyclo-[3.1.0]hex-3-ene]} |
| PR-266 | spiro{1-methylcyclohexane-2,2'-[4'-phenyl-6'-(4-nitrophenyl)-1',3'-diazabicyclo[3.1.0]hex-3-ene]} |
| PR-267 | spiro{1-methylcyclohexane-4,2'-[4'-phenyl-6'-(4-nitrophenyl)-1',3'-diazabicyclo[3.1.0]hex-3-ene]} |
| PR-268 | 2-(4-ethoxycarbonylphenyl)-4,6-diphenyl-1,3-diazabicyclo[3.1.0]hex-3-ene |
| PR-269 | 2,4-diphenyl-6-(benzoyloxyphenyl)-1,3-diazabicyclo[3.1.0]hex-3-ene |
| PR-270 | 2,6-di(1-naphthyl)-4-nitro-1,3-diazabicyclo[3.1.0]hex-3-ene |
| PR-271 | 2,6-di(4-nitrophenyl)-4-phenyl-1,3-diazabicyclo[3.1.0]hex-3-ene |
| PR-272 | 2,4-diphenyl-6-(3-nitrophenyl)1,3-diazabicyclo[3.1.0]hex-3-ene |
| PR-273 | 2,6-diphenyl-4-(4-nitrophenyl)-1,3-diazabicyclo[3.1.0]hex-3-ene |
| PR-274 | 2-(4-tolyl)-4-phenyl-6-(4-nitrophenyl)-1,3-diazabicyclo[3.1.0]hex-3-ene |
| PR-275 | 2,6-di(4-tolyl)-4-phenyl-1,3-diazabicyclo[3.1.0]hex-3-ene |
| PR-276 | 2,4,6-tri(2-aminophenyl)-1,3-diazabicyclo[3.1.0]hex-3-ene |
| PR-277 | 2-(4-diethylaminophenyl)-4,6-diphenyl-1,3-diazabicyclo[3.1.0]hex-3-ene |
| PR-278 | 2,4-diphenyl-6-(4-morpholinophenyl)-1,3-diazabicyclo[3.1.0]hex-3-ene |
| PR-279 | 2-benzyl-4-nitro-6-phenyl-1,3-diazabicyclo[3.1.0]hex-3-ene |
| PR-280 | 2,4-diphenyl-6-(4-ethylphenyl)-1,3-diazabicyclo[3.1.0]hex-3-ene |
| PR-281 | 2,4-diphenyl-6-(4-nitrophenyl)-1,3-diazabicyclo[3.1.0]hex-3-ene |

TABLE VIII-continued

| Exemplary 1,3-Diazabicyclo[3.1.0]-hex-3-ene Photoreductants | |
|---|---|
| PR-282 | 1-azonia-4,6-diphenyl-1-methyl-3-azabicyclo[3.1.0]hex-3-ene tetrafluoroborate |
| PR-283 | 1-azonia-4,6-diphenyl-1,2,2-trimethyl-3-azabicyclo[3.1.0]hex-3-ene hexafluorophosphate |
| PR-284 | 1-azonia-4-phenyl-6-(4-nitrophenyl)-1,2,2-trimethyl-3-azabicyclo[3.1.0]hex-3-ene tetrafluoroborate |
| PR-285 | 1-azonia-4-nitro-2,6-diphenyl-3-azabicyclo[3.1.0]hex-3-ene chloride |
| PR-286 | 4,6-diphenyl-1,3-diazabicyclo[3.1.0]hex-3-ene-1-oxide |
| PR-287 | 2,2-dimethyl-6-(4-nitrophenyl)-4-phenyl-1,3-diazabicyclo[3.1.0]hex-3-ene-1-oxide |
| PR-288 | spiro{cyclopentane-1,2'-[4'-phenyl-6'-(4-nitrophenyl)-1',3'-diazabicyclo-[3.1.0]hex-3-ene-1-oxide]} |
| PR-289 | spiro{1-methylcyclohexane-4,2'-[2',4',6'-triphenyl-1',3'-diazabicyclo[3.1.0]hex-3-ene-1-oxide]} |
| PR-290 | spiro{1-cycloheptane-1,2'-[2',2'-dicyclopropyl-4',6'-di(4-nitrophenyl)-1',3'-diazabicyclo[3.1.0]hex-3-ene-1-oxide]} |

While each of the various categories of photoreductants noted above form a redox couple with cobalt(III)-complexes upon exposure to actinic radiation of a wavelength longer than 300 nanometers, the photoreductants vary somewhat in the manner and mechanism through which they react. Many of the photoreductants react rapidly with the cobalt(III)complex upon exposure to actinic radiation. Certain of the quinone photoreductants exhibit this reaction characteristic. Other of the photoreductants form a redox couple upon exposure, but require an extended period to reduce the cobalt(III)complex. In most instances it is desirable to heat the redox couple formed by the exposed photoreductant and cobalt(III)complex to drive the reaction to a more timely completion. Although optimum levels of heating vary considerably, depending upon specific choices of photoreductants, cobalt(III)complexes, other materials present and desired photographic speeds, typically, heating the redox couple in the temperature range of from 80° to 150° C. is preferred. Exposure causes the 2H-benzimidazoles to be converted to the corresponding dihydrobenzimidazoles, which are reducing agents. Heating in the range of from 100° to 150° C. converts the remaining 2H-benzimidazole to 1H-benzimidazole, which is neither a photoreductant nor a reducing agent. In the case of aziridene photoreductants exposure converts the aziridene to a reducing agent precursor and heating to temperature of from 80° to 150° C. is required to form the reducing agent, preferably from 100° to 150° C.

Photoreductant Adjuvants

The photoreductants employed in the practice of this invention shift the position of or change the number of atoms contained within the molecule in the course of conversion to the corresponding reducing agent. Internal hydrogen source quinones and the aziridenes are exemplary of photoreductants capable of relying entirely on the atoms initially present within the molecule to permit conversion to the corresponding reducing agent. In other photoreductants conversion to the corresponding reducing agent may require that an adjuvant be present in intimate association with the photoreductant to donate the necessary atoms to permit formation of the reducing agent. For example, in quinones and 2H-benzimidazoles lacking an internal hydrogen source it is necessary to employ in combination an adjuvant capable of functioning as an external source of hydrogen atoms. In most instances I have observed significant improvements in performance by employing in combination with the photoreductants an adjuvant, such as an external hydrogen source, to facilitate conversion of the photoreductant to a reducing agent, whether or not the photoreductant itself contains the requisite atoms for its conversion to a reducing agent.

Any conventional source of labile hydrogen atoms that is not otherwise reactive with the remaining components or their reaction products contained within the photographic element can be utilized as an adjuvant. Generally preferred for use are organic compounds having a hydrogen atom attached to a carbon atom to which a substituent is also attached which greatly weakens the carbon to hydrogen bond, thereby rendering the hydrogen atom labile. Preferred hydrogen source compounds are those which have a hydrogen atom bonded to a carbon atom to which is also bonded the oxygen atom of an oxy substituent and/or the trivalent nitrogen atom of an amine substituent. As employed herein the term "amine substituent" is inclusive of amide and imine substituents. Exemplary preferred substituents which produce marked lability in a hydrogen atom associated with a common carbon atom are oxy substituents, such as hydroxy, alkoxy, aryloxy, alkaryloxy and aralkoxy substituents and amino substituents, such as alkylarylamino, diarylamino, amido, N,N-bis(1-cyanoalkyl)amino, N-aryl-N-(1-cyanoalkyl)amino, N-alkyl-N-(1-cyanoalkyl)amino, N,N-bis-(1-carbalkoxyalkyl)amino, N-aryl-N-(1-carbalkoxyalkyl)amino, N-alkyl-N-(1-carbalkoxyalkyl)amino, N,N-bis(1-nitroalkyl)amino, N-alkyl-N-(1-nitroalkyl)amino, N-aryl-N-(1-nitroalkyl-)amino, N,N-bis(1-acylalkyl)amino, N-alkyl-N-(1-acylalkyl)amino, N-aryl-N(1-acylalkyl)amino, and the like. The aryl substituents and substituent moieties are preferably phenyl or phenylene while the aliphatic hydrocarbon substituents and substituent moieties preferably incorporate twenty or fewer carbon atoms and, most preferably, six or fewer carbon atoms. Exemplary of compounds which can be used in the practice of this invention for the purpose of providing a ready source of labile hydrogen atoms are those set forth in Table IX. Compounds known to be useful in providing labile hydrogen atoms are also disclosed in U.S. Pat. No. 3,383,212, issued May 14, 1968, the disclosure of which is here incorporated by reference.

TABLE IX

| Exemplary External Hydrogen Source Compounds | |
|---|---|
| HS- 1 | poly(ethylene glycol) |
| HS- 2 | phenyl-1,2-ethanediol |
| HS- 3 | nitrilotriacetonitrile |
| HS- 4 | triethylnitrilotriacetate |
| HS- 5 | poly(ethylene glycol) |
| HS- 6 | poly(vinyl butyral) |
| HS- 7 | poly(vinyl acetal) |
| HS- 8 | 1,4-benzenedimethanol |
| HS- 9 | methyl cellulose |
| HS-10 | cellulose acetate butyrate |
| HS-11 | 2,2-bis-(hydroxymethyl)-propionic acid |
| HS-12 | 1,3-bis-(hydroxymethyl)-urea |
| HS-13 | 4-nitrobenzyl alcohol |
| HS-14 | 4-methoxybenzyl alcohol |
| HS-15 | 2,4-dimethoxybenzyl alcohol |
| HS-16 | 3,4-dichlorophenylglycol |
| HS-17 | N-(hydroxymethyl)-benzamide |
| HS-18 | N-(hydroxymethyl)-phthalimide |
| HS-19 | 5-(hydroxymethyl)-uracil hemihydrate |

TABLE IX-continued

| Exemplary External Hydrogen Source Compounds | |
|---|---|
| HS-20 | nitrilotriacetic acid |
| HS-21 | 2,2',2"-triethylnitrilotripropionate |
| HS-22 | 2,2',2"-nitrilotriacetophenone |
| HS-23 | poly(vinyl acetate) |
| HS-24 | poly(vinyl alcohol) |
| HS-25 | ethyl cellulose |
| HS-26 | carboxymethyl cellulose |
| HS-27 | poly(vinyl formal) |

The external hydrogen source adjuvants incorporated within the photographic elements of the present invention can, in fact, perform more than one function. For example, the polymers included in Table IX can also be used as binders as well as to provide a source of labile hydrogen atoms. These compounds are designated as external hydrogen source compounds only to point up that the labile hydrogen atoms are not incorporated in the photoreductant.

Image-Forming Layer and Element

To form an image-forming composition useful in the present invention it is merely necessary to bring together the chelating compound and the cobalt(III)complex. If it is desired that the image-forming composition also be radiation sensitive above about 300 nanometers, as is typically preferred, this can be accomplished by including in the composition a photoactivator—i.e., a spectral sensitizer and/or photoreductant. If required by the choice of photoreductant, an adjuvant should also be included. The image-forming composition can then be brought into a spacially fixed relationship, as by coating the composition onto a support to form an image-forming element according to the present invention. For maximum efficiency of performance it is preferred that the components of the image-forming composition, particularly, the chelating compound and the cobalt(III)complex, as well as the photoactivator and the adjuvant, if any, be intimately associated. This can be readily achieved, for example, by dissolving the reactants in a solvent system.

The solvent system can be a common solvent or a combination of miscible solvents which together bring all of the reactants into solution. Typical preferred solvents which can be used alone or in combination are lower alkanols, such as methanol, ethanol, isopropanol, t-butanol and the like; ketones, such as methylethyl ketone, acetone and the like; water; liquid hydrocarbons; chlorinated hydrocarbons, such as chloroform, ethylene chloride, carbon tetrachloride and the like; ethers, such as diethyl ether, tetrahydrofuran, and the like; acetonitrile; dimethyl sulfoxide and dimethyl formamide.

For ease of coating and for the purposes of imparting strength and resilience to the image-forming layer it is generally preferred to disperse the reactants in a resinous polymer matrix or binder. A wide variety of natural and synthetic polymers can be used as binders. In order to be useful it is only necessary that the binders be chemically compatible with the reactants. In addition to performing their function as a binder the polymers can also serve as adjuvants such as external hydrogen sources to supplement or replace other adjuvants such as hydrogen sources as described above.

It is preferred to employ linear film-forming polymers such as, for example, gelatin, cellulose compounds, such as ethyl cellulose, butyl cellulose, cellulose acetate, cellulose triacetate, cellulose butyrate, cellulose acetate butyrate and the like; vinyl polymers, such as poly(vinyl acetate), poly(vinylidene chloride), a poly(vinyl acetal) such as poly(vinyl butyral), poly(vinyl chloride-co-vinyl acetate), polystyrene, polybutadiene, poly(vinylpyrrolidone), and polymers of alkyl acrylates and methacrylates including copolymers incorporating acrylic or methacrylic acid as well as copolymers thereof; and polyesters, such as poly(ethylene glycol-co-isophthalic acid-co-terephthalic acid), poly(p-cyclohexane dicarboxylic acid-co-isophthalic acid-co-cyclohexylenebismethanol), poly(p-cyclohexanedicarboxylic acid-co-2,2,4,4-tetramethylcyclobutane-1,3-diol) and the like. The condensation product of epichlorohydrin and bisphenil is also a preferred useful binder. Generally any binder known to have utility in photographic elements and, particularly, diazo photographic elements can be used in the practice of this invention. These binders are well known to those skilled in the art so that no useful purpose would be served by including an extensive catalogue of representative binders in this specification. Any of the vehicles disclosed in *Product Licensing Index* Vol. 92, December 1971, publication 9232, at page 108, can be used as binders in the radiation-sensitive elements of this invention.

While the proportions of the reactants forming the radiation-sensitive layer can be varied widely, it is generally preferred for most efficient utilization of the reactants that they be present in roughly stoichiometric concentrations—that is, equal molar concentrations. One or more of the reactants can, of course, be present in excess. For example, where the external hydrogen source is also used as a binder, it is typically present in a much greater concentration than is essential merely for donation of labile hydrogen atoms. It is generally preferred to incorporate from 0.1 to 10 moles of the cobalt(III)complex per mole of the chelating compound and the photoactivator, if any. The relative concentrations of the chelating compound and photoactivator can be similarly varied. The spectral sensitizers can be employed in concentrations of from 0.01 to 100 moles of the cobalt(III)complex per mole of sensitizer. Adjuvants, such as external hydrogen sources, supplied solely to perform this function are typically conveniently incorporated in concentrations of from 0.5 to 10 moles per mole of photoreductant. The binder can account for up to 99% by weight of the radiation-sensitive layer, but is typically employed in proportions of from 50 to 90% by weight of the radiation-sensitive layer. It is, of course, recognized that the binder can be omitted entirely from the radiation-sensitive layer. The surface or areal densities of the reactants can vary, depending upon the specific application; however, it is generally preferred to incorporate the cobalt(III)complex in a concentration of at least $1\times10^{-7}$ moles per square decimeter and, most preferably, in a concentration of from $1\times10^{-5}$ to $1\times10^{-4}$ moles per square decimeter. The areal densities of the remaining reactants are, of course, proportionate. It is generally preferred that the concentration of spectral sensitizer be chosen to provide a net optical density at its maximum absorption wavelength longer than 300 nanometers in the range of from 0.1 to 3.0, most preferably of from 0.5 to 2.0. Typically, the radiation-sensitive layer can vary widely in thickness depending on the characteristics desired for the radiation-sensitive element—e.g., image density, flexibility, transparency, etc. For most photographic applications coating thicknesses in the range of from 2 microns to 20 microns are preferred.

Any conventional photographic support can be used in the practice of this invention. Typical supports include transparent supports, such as film supports and glass supports as well as opaque supports, such as metal and photographic paper supports. The support can be either rigid or flexible. Preferred supports for most applications are paper or film supports. The support can incorporate one or more subbing layers for the purpose of altering its surface properties. Typically subbing layers are employed to enhance the adherency of the radiation-sensitive coating to the support. Suitable exemplary supports are disclosed in *Product Licensing Index* Vol. 92, December 1971, publication 9232 at page 108.

The radiation-sensitive layer can be formed on the support using any conventional coating technique. Typically the reactants, the binder (if employed) and any other desired addenda are dissolved in a solvent system and coated onto the support by such means as whirler coating, brushing, doctor blade coating, hopper coating and the like. Thereafter the solvent is evaporated. Other exemplary coating procedures are set forth in the *Product Licensing Index* publication cited above, at page 109. Coating aids can be incorporated into the coating composition to facilitate coating as disclosed on page 108 of the *Product Licensing Index* publication. It is also possible to incorporate antistatic layers and/or matting agents as disclosed on this page of the *Product Licensing Index* publication.

As is illustrated in FIG. 1, in a simple form the image-forming element 100 can be formed entirely of a support 102 and an image-forming layer 104. In a simple form the image-forming element can be employed to record the image formed, although this is not required. Where the image-forming layer does not incorporate a photoactivator, an image can be formed by exposing the image-forming layer to ultra-violet radiation. As is known to those skilled in the art cobalt(III)complexes are generally reducible by radiation of a wavelength in the range of from 100 to 300 nanometers. By employing a photoactivator in the image forming layer reduction of the cobalt(III)complex can be initiated by exposure to electromagnetic radiation of wavelengths longer than 300 nanometers and up to about 900 nanometers.

While I do not wish to be bound by any particular theory by which my image-forming elements respond to electromagnetic radiation, I have observed that my image-forming layers are exceptionally responsive to actinic radiation and produce images with such speed and/or density that it is clear that internal gain is occurring within the image-forming layer. I believe that imagewise exposure to electromagnetic radiation initiates reduction of the cobalt(III)complex initially present. This can be caused by the photoactivator being converted to a reducing agent for the cobalt(III)complex, as where a photoreductant is employed as a photoactivator; by the photoactivator sensitizing the cobalt(III)complex to longer wavelength radiation, as where a spectral sensitizer is employed as a photoactivator; or by the cobalt(III)complex being directly reduced by shorter wavelength radiation. The cobalt(III)complex then decomposes, and the cobalt(II)atoms produced by reduction of the complex form a bidentate chelate with the chelating compound. To the extent that the image-forming coating is free of anions of acids having high pKa values the cobalt(III)chelate complex is not deprotonated to a non-catalytic form. By maintaining the coating predominantly free of anions of acids having high pKa values the major portion of the cobalt(II)complex is not deprotonated, but reduces adjacent remaining cobalt(III)complex. This converts the cobalt(II)chelate complex to a stable cobalt(III)complex. The cobalt(III)chelate complex forms at least a bidentate chelate, and most typically a tridentate chelate, including the $\pi$ bonded chelating compound. At the same time the initially present cobalt(III)complex is reduced in this reaction to liberate ligands, and the cobalt(II) atoms produced by reduction of the complex form a bidentate chelate with remaining chelating compound. The cobalt(II)chelate complex then reduces additional remaining cobalt(III)complex initially present. It is thus apparent that the reactions whereby the final cobalt(III)chelate complex are produced are essentially self-catalyzing once initiated and that the reactions will continue until the chelating compound and/or initial cobalt(III)complex are entirely depleted in the area of exposure. It is also apparent that is is not necessary to initiate image formation by imagewise exposure. Image formation could, if desired, be initiated by any alternative triggering mechanism. For example, image formation could be initiated if a cobalt(II)chelate complex were simply image-wise applied to the image-forming layer.

In most instances the image-forming layer can also be employed as an image-recording layer, since the cobalt(III)chelate complex produced typically forms an optically dense image that is a negative of the exposure image and that is readily distinguished from the background areas lacking this complex. In most instances the image-forming layer can be formed to be initially yellow to transparent with a dense image being formed in exposed areas. Where it is desired to choose the reactants to purposely impart an optical density to the unexposed areas, the imagewise exposed areas can be visually detected as being of a distinct hue.

It is, however, not required that any image be recorded in the image-forming layer. In this form the image-forming element need not exhibit an image-recording capability, rather the image-forming element merely exhibits a selective response to imagewise activation. The selective response can be usefully employed, as in recording the image in a separate photographic element. In a preferred image-forming element of this type the cobalt(III)complex initially present incorporates one or more ligands which can be volatilized upon reduction of the complex. For example, the cobalt(III)complex can incorporate one or more ammine ligands which are liberated as ammonia upon imagewise reduction of the cobalt(III)complex. For such an application it is preferred to choose a cobalt(III)complex which incorporates a large number of ammine ligands, as are present in cobalt hexa-ammine and cobalt penta-ammine complexes. Alternatively, the imaging-forming layer can take the form of a composite coating of two contiguous layers, one of which contains a quinone photoreductant and the other of which contains the cobalt(III)complex and the compound containing a conjugated $\pi$-bonding system as shown in Example 1.

Separate Image-Recording Layers and Elements

Where the image-forming layers employed in the practice of this invention do not incorporate an image-recording capability or external image recordation is otherwise desired, it is contemplated that a separate image-recording layer be used with the image-forming layer. In a simple form a separate image-recording element can be used in combination with an image-forming element, such as element 100. In this way reaction products released upon imagewise activation of the image-forming element can be transferred in an image pattern to produce an image printout or bleachout in the image-recording layer. In one form of the invention it is contemplated that ammonia will be imagewise transferred from the image-forming layer to a separate image-recording element. In such instance the image-recording element can take the form of any conventional element containing a layer capable of producing an image as a result of ammonia receipt or, more generally, contact with a base.

In a simple form the image-recording element can consist of a support bearing thereon a coating including a material capable of either printout or bleachout upon contact with ammonia. For example, materials such as phthalaldehyde and ninhydrin printout upon contact with ammonia and are therefore useful in forming negative images. A number of dyes, such as certain types of cyanine dyes, styryl dyes, rhodamine dyes, azo dyes, etc. are known to be capable of being altered in color upon contact with a base. Particularly preferred for forming positive images are dyes which are bleached by contact with a base, such as ammonia, to a substantially transparent form. Pyrylium dyes have been found to be particularly suited for such applications. While the image-recording layer can consist essentially of a pH or ammonia responsive imaging material, in most instances it is desirable to include a binder for the imaging material. The image-recording element can be formed using the same support and binder materials employed in forming the image-forming element or formed in any other convenient, conventional manner.

To record an image using separate image-forming and image-recording elements, the image-forming layer of the image-forming element is first imagewise activated, as by being exposed to radiation of from 300 to about 900 nm, preferably to radiation of from 300 to 700 nm. Exposure can be accomplished using a mercury arc lamp, carbon arc lamp, photoflood lamp, laser or the like. Where a redox couple is formed by the cobalt(III) and the photoactivator that reacts rapidly at ambient temperatures, it is desirable to have the image-recording layer of the image-recording element closely associated with the image-forming layer at the time of activation. Where the redox couple reacts more slowly, as in those instances where it is desirable to drive the redox reaction to completion with the application of heat, the image-recording element can be associated with the image-forming element before or after activation. For example, in one form a radiation-sensitive image-forming element can be exposed and thereafter associated with the image-recording element, as by feeding the elements with the image-forming and image-recording layers juxtaposed between heated rolls. After the image-forming layer has been used to produce an image in the image-recording element, it can be discarded or, where a more slowly reacting redox couple is formed, reused with another image-recording element to provide another photographic print.

Figure 2:
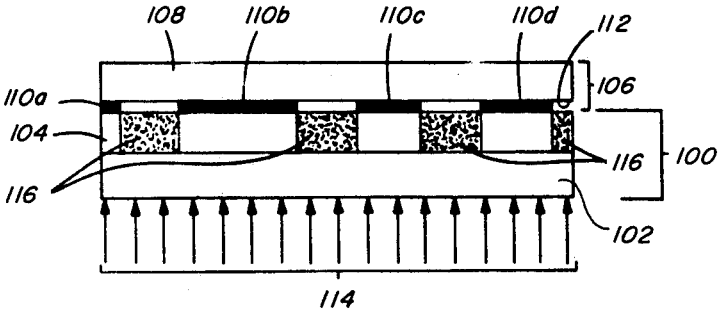
FIG. 2 is a schematic diagram of the radiation-sensitive element in combination with an original image bearing element receiving a reflex exposure.
Figure 3:
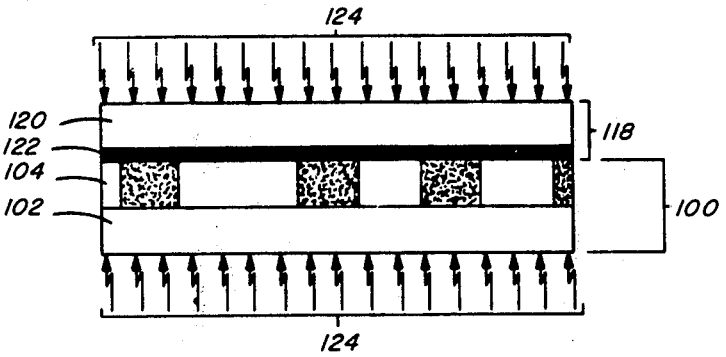
FIG. 3 is a schematic diagram of the radiation-sensitive element in combination with a copy sheet receiving thermal processing.
Figure 4:
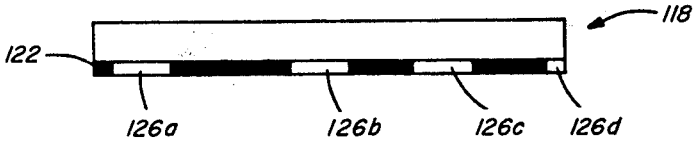
FIG. 4 is a schematic diagram of the imaged copy sheet.

A further illustrative practice of this invention employing a radiation-sensitive image-forming element and a separate image-recording element can be appreciated by reference to FIGS. 2 through 4 of the drawings. In FIG. 2 the radiation-sensitive image-forming element 100 comprised of support 102, which in this instance is a substantially transparent support, and radiation-sensitive image-forming layer 104, is placed in contact with an article 106 to be copied comprised of support 108 and coated image areas 110*a*, 110*b*, 110*c* and 110*d*. The support is formed to provide a reflective surface. For example, the support can be paper or can be formed with a reflective coating. The image areas are formed using a material which is substantially absorptive within the spectrum of exposure.

With the elements 100 and 106 associated as illustrated the radiation-sensitive element is uniformly exposed to actinic radiation, indicated schematically by arrows 114, through the support 102. Substantially all of the radiation reaches and penetrates the radiation-sensitive layer 104. A significant portion of the radiation reaches the article to be copied and is either absorbed or reflected back into the radiation-sensitive image-forming layer, depending upon whether the radiation impinges upon the reflective surface 112 or the image areas. As a result of differential availability of actinic radiation to the radiation-sensitive image-forming layer, exposed zones 116 which contain a volatilizable reaction product are formed in the image-forming layer.

After exposure the image-forming element is separated from the article to be copied and is brought into contact with an image-recording element comprised of a support 120 and an image-recording layer 122 as shown in FIG. 3. The image-recording layer is shown to be initially colored, but capable of being bleached, although an initially colorless image-recording layer that is capable of being colored could be alternatively employed. Upon the uniform application of heat, as is schematically illustrated by the arrows 124, the volatilizable reaction product formed in the exposed areas 116 diffuses from the radiation-sensitive layer 104 to the adjacent image-recording layer 122 and causes the image-recording layer to become bleached in areas 126*a*, 126*b*, 126*c* and 126*d*, as shown in FIG. 4. Thus, a positive copy of the article 106 is formed. By employing an initially colorless image-recording layer that is colored by receipt of reaction products from the image-forming layer a negative copy of the article can be formed. It is thus apparent that either positive or negative copies can be formed by reflex exposure techniques according to the practice of this invention. It is, of course, recognized that the practice of this invention is not limited to reflex exposure techniques, although these are advantageous for many applications.

Instead of employing separate image-forming and image-recording elements, separate image-forming and image-recording layers can be incorporated within a single element. This can be illustrated by reference to FIG. 5. An element 200 is schematically shown comprised of a support 202 and an image-forming layer 204, which can be identical to support 102 and image-forming layer 104, respectively, described above. Overlying the image-forming layer is a separation layer 206. An image-recording layer 208, which can be identical to the separate image-recording layers previously discussed, overlies the separation layer. If desired, the relationship of the image-recording and image-forming layers can be interchanged.

The separation layer is an optional component of the element 200, since in most instances the image-recording and image-forming layers are chemically compatible for substantial time periods. However, to minimize any degradation of properties of either of the active layers due to migration of chemical components from one layer to the other, as could conceivably occur during extended periods of storage before use, it is preferred to incorporate the separation layer.

The separation layer is chosen to be readily permeable by the reaction product(s) to be released from the image-forming layer upon exposure while impeding unwanted migration of initially present components of the radiation-sensitive and image-recording layers. For example, the separation layer can be chosen to be readily permeable to ammonia, but relatively impermeable to liquid components. It has been found that a wide range of polymeric layers will permit diffusion of gaseous ammonia from the radiation-sensitive layer to the image-recording layer while otherwise inhibiting interaction of the components of these layers. It is generally preferred to employ hydrophobic polymer layers as separation layers where the image-forming and image-recording layers incorporate polar reactants whose migration is sought to be inhibited. Most preferred are linear hydrocarbon polymers, such as polyethylene, polypropylene, polystyrene and the like. It is generally preferred that the separation layer exhibit a thickness of less than about 200 microns in order to allow image definition to be retained in the image-recording layer. For most applications separation layers of 20 or fewer microns are preferred.

The radiation-sensitive image-forming layers and elements employed in the practice of this invention do not require fixing after exposure and image formation. While stability of the images formed can vary somewhat, depending upon the specific choice of reactants, it has been observed that the images produced by the image-forming layers can be exposed to room light and temperatures without destroying the images. Where it is desired to stabilize the image to permit retention for an extended time period under room conditions, re-exposure to high intensity actinic radiation, subsequent heating above ambient temperatures, etc., it is possible to fix the image. A number of alternative fixing approaches are possible, depending upon the specific choice of reactants. As noted above, where a benzimidazole is employed as a photoreductant, heating in the range of from 100° to 150° C. converts 2H-benzimidazole to 1H-benzimidazole and thereby fixes the image forming layer containing this photoreductant. In other instances it is possible to fix the image by selectively dissolving out the unexposed photoactivator and/or cobalt(III)-complex. Certain of the chelate forming compounds can be fixed by fuming, swabbing or bathing the image-forming layer with an acid after exposure and image formation. The aziridene photoreductants can be similarly fixed.

Photoresponsive Image-Recording Layers and Elements

Figure 5:
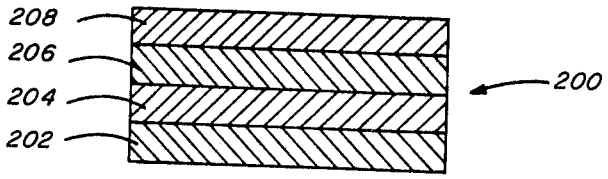
FIG. 5 is a schematic diagram of a composite radiation-sensitive imaging element.

While the separate image-recording layers heretofore described need not themselves be radiation responsive, image-recording layers which are responsive both to reaction products released by the image-forming layers and also directly responsive to actinic radiation are recognized to be useful in the practice of this invention. For example, a conventional diazo recording element can be used as an image-recording element in the practice of this invention. Typically diazo recording elements are first imagewise exposed to ultraviolet light to inactivate radiation-struck areas and then uniformly contacted with ammonia to printout a positive image. Diazo recording elements can initially incorporate both a diazonium salt and an ammonia activated coupler (commonly referred to as two-component diazo systems) or can initially incorporate only the diazonium salt and rely upon subsequent processing to imbibe the coupler (commonly referred to as one-component diazo systems). Both one component and two component diazo systems can be employed in the practice of this invention. Subsequent discussions, although directed to the more common two component diazo systems, should be recognized to be applicable to both systems. The photo-responsive image-recording layers can be incorporated in separate image-recording elements or can be incorporated directly within the image-forming elements of this invention, such as illustrated in FIG. 5.

The use of a radiation-sensitive image-forming layer and a separate photoresponsive image-recording layer in combination offers a versatility in imaging capabilities useful in forming positive and/or negative images. The production of a positive image with such a combination can be readily appreciated by reference to FIG. 6. In this figure a radiation-sensitive image-forming layer 302 and a photoresponsive image-recording layer 304, such as a conventional diazo recording layer, are associated in face-to-face relationship. The layers together with a support and separation layer can, if desired, form a single element, such as element 200, or, in the alternative, the separate layers can be provided by placing a conventional diazo recording element and the image-forming element 100 in face-to-face relationship. As employed herein the term "face-to-face relationship" means simply that the image-recording and image-forming layers are adjacent and not separated by a support, as would occur in a back-to-back relationship.

To form a positive image the photosensitive image-recording layer 304 is first imagewise exposed to ultraviolet radiation, as is schematically indicated by transparency 306 bearing the image 308. This photolytically destroys the diazonium salt in the exposed areas of the image-recording layer. The image-forming layer 302 is preferably uniformly exposed to actinic radiation before it is associated with the layer 304, where separate image-recording and image-forming elements are employed. Alternatively, where a single element is employed incorporating layers 302 and 304, the image-forming layer is uniformly exposed using radiation in the visible spectrum so as not to destroy the diazonium salt in image areas. Exposures through either major outer surface are contemplated where the layers 302 and 304 form a single element. Transparent or opaque supports can be used with either single or plural element arrangements. Heating of the layers 302 and 304 in face-to-face relationship results in ammonia being released from the image forming layer for migration to the diazo layer, thereby activating the coupler in the diazo layer to produce a dye image 310, which is a positive copy of the image 308. If an element bearing a negative image is substituted for transparency 306, the negative image will be reproduced in the layer 304.

Figure 6:
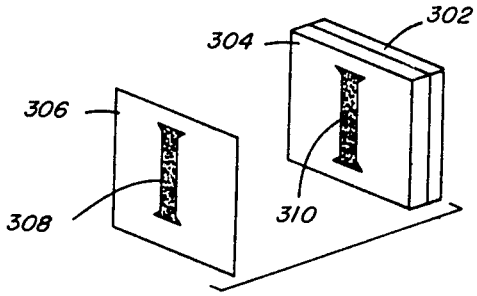
FIGS. 6 and 7 are schematic diagrams of an original image bearing element and an image bearing radiation-sensitive composite.
Figure 7:
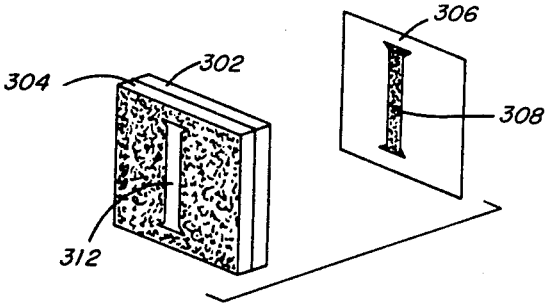

The identical photosensitive image-recording and separate image-forming layer combination employed to form a positive image in FIG. 6 can also be used to form a negative image, as illustrated in FIG. 7. To form a negative image the image-forming layer is first imagewise exposed, as indicated by the transparency 306 bearing the image 308. Where the layers 302 and 304 are in separate elements the image-forming element is preferably exposed before association with the image-recording element. Where the layers are in a single element, the radiation-sensitive layer is preferably exposed with visible radiation to avoid deactivating the diazo layer. With the layers associated as shown, they are uniformly heated. This imagewise releases ammonia from the image-forming layer which migrates to the diazo layer, causing image-wise printout. The area of the diazo layer defining the negative image 312 can then be deactivated by exposure to ultraviolet light, if desired, although this is not required. The image 312 is a negative copy of the image 308. If an element bearing a negative image is substituted for transparency 306, the image will be reversed in the layer 304.

Where the image-forming and image-recording layers lie in separate elements and where an image is formed in the image-recording layer as described with reference to FIG. 7, it is possible to associate a second image-recording element with the image-forming element and obtain a second image which is a reversal of the image recorded in the first image-recording element. For example, as described above the formation of a negative image in the image-recording layer 304 is described. To form a second image, in this case a positive image, it is merely necessary to bring a second image-recording element into face-to-face association with the image-forming layer. The image-forming layer either before or after association is then given an overall or fogging exposure. This produces volatilizable reaction product in all of the areas not originally exposed upon imagewise exposure. Subsequent heating then imagewise transfers the additionally formed reaction product to the image-recording layer of the second image-recording element. Thus, if a negative image has been formed in the first image-recording element, a positive image will be formed in the second image-recording element and vice versa.

Numerous variations are contemplated and will be readily apparent to those skilled in the art. For example, the photoactivator of the image-forming layer and the photoresponsive image-recording layer can be variously chosen to be responsive to other portions of the spectrum. Instead of using a photoactivator which is responsive to visible light and the diazo layer being responsive to ultraviolet light, as noted above, a diazonium salt can be chosen which is selectively responsive to visible light and the image-forming layer can be chosen to be selectively responsive to either visible or ultraviolet light. Where both the image-forming and photoresponsive image-recording layers are present in a single element and are responsive to the same portion of the spectrum, it is desirable to provide a transparent support and to include a separation layer that is substantially opaque to actinic radiation. It is also contemplated that for certain applications the separation layer can advantageously be formed of or include an ultraviolet absorbing material. In still another variation, where uniform ammonia release is employed to develop the diazo image, a supplementary base treatment can be used to enhance the diazo image if desired.

Multi-Color Elements

In the foregoing description the radiation-sensitive image-forming and image-recording elements have been described for simplicity in terms of a single image-forming or image-recording layer being employed capable of producing an image by increasing or reducing optical density with respect to a background or by producing a visibly distinguishable coloration with respect to the background area. It is to be recognized that the present invention is fully applicable to forming multi-color images, as by the use of plural radiation-sensitive image-forming layers each responsive to a different portion of the visible electromagnetic spectrum.

Figure 8:
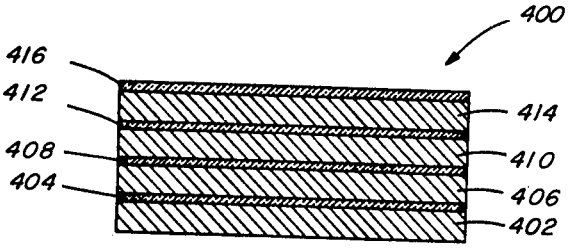
FIG. 8 is a schematic diagram of a multi-layer, multicolor image recording radiation-sensitive element.

An exemplary multi-color image forming element according to this invention is shown in FIG. 8. The element 400 is comprised of a support 402. A conventional subbing layer or layer combination 404 is interposed between the support and a first radiation-sensitive image-forming layer 406. Separated from the first radiation-sensitive image-forming layer by a first transparent interlayer 408 is a second radiation-sensitive image-forming layer 410. Similarly a second transparent interlayer 412 separates the second image-forming layer and a third radiation-sensitive image-forming layer 414. A protective transparent overlayer 416 overlies the third image-forming layer. In a simple, preferred form of the invention the interlayers, the overlayer and the photographic vehicles for the image-forming layers can be gelatin or a combination of gelatin and synthetic polymer. Both the interlayers and overlayer are optional and can be omitted, if desired. In a preferred form the spectral sensitization of the third image-forming layer extends only through the blue region of the spectrum while the second image-forming layer is sensitized only through the blue and green regions of the spectrum or sensitized only to the green portion of the spectrum and the sensitization of the first image-forming layer extends through the entire visible spectrum or can be sensitized to only the red portion of the spectrum.

By choosing spectral sensitizers that are responsive to different portions of the visible electromagnetic spectrum for inclusion in each of the image-forming layers a multi-color image can be recorded. For example, in one form of the invention a color coupler can be selectively incorporated in each image-forming layer to produce a subtractive primary color which absorbs electromagnetic radiation corresponding to the range of the spectrum to which the layer has been sensitized. By processing the radiation-sensitive image-forming element after exposure with conventional color development solutions a multi-color image can be produced which is a negative of the multi-color imaging exposure. This element can be used to print a positive of the multi-color imaging exposure, if desired.

In another form chelating compounds can be included in the radiation-sensitive layers which will produce colored images in each layer of any desired color. Such chelating compounds can be chosen to produce subtractive primaries in each of the radiation-sensitive layers so that a colored negative of the original multi-color imaging exposure can be achieved. It is to be noted that the choice of color image to be formed within the radiation-sensitive layers can be independent of the portion of the electromagnetic spectrum to which the layer is sensitized. Hence, it is possible to produce images which are either positive or negative reproductions of the exposure image or which form the exposure image in a different color combination altogether.

This invention can be better appreciated by reference to the following examples:

EXAMPLE 1

Two solutions of the following compositions were prepared:

Solution A

-continued

| | | |
|---|---|---|
| 2-isopropoxy-1,4-naphthoquinone (PR-145) | 0.216 | gram |
| poly(styrene-co-butadiene) | 1.000 | gram |
| toluene | 10.0 | ml |
| Solution B | | |
| hexa-ammine cobalt(III) trifluoroacetate (C-3) | .50 | gram |
| 1-(2-pyridylazo)-2-naphthol | 0.12 | gram |
| poly(vinylpyrrolidone) | 1.0 | gram |
| methanol | 10.0 | ml |

Solution A was coated at 100 microns wet thickness on a poly(ethylene terephthalate) support and dried. This coated layer was then overcoated with Solution B at 100 microns wet thickness and dried. A sample of this composite coating was exposed for 0.10 second using an exposure unit providing a near ultraviolet and blue 400 watt light source commercially available under the tradename IBM Micro Copier II D. The exposed sample was then passed between a pair of rolls heated to 120° C. A cyan image having a density of 1.2 was produced. This sample was held under ordinary room lighting for several weeks without any significant density buildup in the background areas. The coating had a sensitivity which extended to about 440 nm as determined with a wedge spectrograph. The photographic speed of the coating was about 60 times greater than that of Kodak Diazo Type M film.

EXAMPLE 2

A solution of the following composition was prepared:

| Solution C | | |
|---|---|---|
| hexa-ammine cobalt(III) trifluoroacetate (C-3) | 0.50 | gram |
| 1-(2-pyridylazo)-2-naphthol | .12 | gram |
| 2-isopropoxy-1,4-naphthoquinone (PR-145) | .216 | gram |
| cellulose acetate butyrate | 1.0 | gram |
| acetone | 10.0 | ml |

Solution C was coated on a poly(ethylene terephthalate) film support at a wet thickness of 100 microns and allowed to dry. A sample of the dried coating was imagewise exposed and processed as described in Example 1 to yield a cyan image with a density >1.0.

Absolute sensitometry showed that an energy of $10^3$ erg/cm$^2$ was required to produce a density of 1.0 at 350 nm. This value indicated that this coating exhibited a speed of about 600 times greater than Kodak Diazo Type M film at 350 nm.

The heat processed film was exposed to HC1 vapor for a few seconds and the image was stabilized against further exposure and processing.

EXAMPLE 3

A solution of the following composition was prepared:

| | | |
|---|---|---|
| hexa-ammine cobalt(III) trifluoroacetate (C-3) | 0.50 | gram |
| 1-(2-pyridylazo)-2-naphthol | 0.12 | gram |
| 2-(N-ethyl-N-benzylamino)-3-chloro-1,4-naphthoquinone (PR-169) | 0.163 | gram |
| cellulose acetate butyrate (HS-10) | 1.0 | gram |
| acetone | 10.0 | ml |

Solution D was coated, dried, exposed and heat processed as described in Example 2. Wedge spectrograph measurements indicated a sensitivity to wavelengths up to 640 nm. $4\times10^3$ erg/cm$^2$ were required to produce a density of 1.0 at 540 nm. The coating was exposed to hydrochloric acid vapors for further protection against background printout.

EXAMPLES 4 through 15

Seventeen solutions were prepared of the following general composition:

| Solution E | | |
|---|---|---|
| cellulose acetate butyrate (HS-10) | 1.0 | gram |
| acetone | 10.0 | ml |
| 1-(2-pyridylazo)-2-naphthol | 0.05 | gram |
| 2-isopropoxy-1,4-naphthoquinone (PR-145) | 0.05 | gram |
| hexa-ammine cobalt(III) salt | 0.25 | millimole |

The cobalt(III) salt in each solution differed solely by the choice of anion as indicated in Table X below. Each coating composition was used to prepare coatings on poly(ethylene terephthalate) film support having a wet coating thickness of approximately 100 microns.

Exposure was undertaken using the 400 watt ultraviolet and blue light source of Example 1. Exposure was made through a 0.3 log E silver step tablet for 0.5 second. The step tablet had seven steps ranging in density from 0.05 to 2.15. Approximately 10 seconds after exposure each radiation-sensitive image-forming element was placed in face-to-face relationship with a diazo recording element commercially available under the trademark Kodak Recordak Diazo M Film. To produce a negative image on the diazo receiver and on the radiation-sensitive image-forming element they were passed once between a pair of rollers heated to 110° C. The speed of the radiation-sensitive image-forming element was judged by the densities produced in the diazo receiver, as indicated below.

TABLE X

| Exemplary Performance As A Function of pKa Values | | | |
|---|---|---|---|
| Example No. | Anion (X) | pKa of Acid (HX) | Speed |
| 4 | perchlorate | −10.5 | very fast |
| 5 | thiocyanate | 0.07 | very fast |
| 6 | trifluoroacetate | 0.20 | very fast |
| 7 | perfluorobutyrate | 0.50 | very fast |
| 8 | trichloroacetate | 0.70 | fast |
| 9 | oxalate | 1.23 | fast |
| 10 | perfluorobenzoate | 1.20 | fast |
| 11 | dichloroacetate | 1.48 | fast |
| 12 | cyanoacetate | 2.45 | fast |
| 13 | chloroacetate | 2.85 | fast |
| 14 | salicylate | 2.97 | very fast |
| 15 | benzilate | 3.00 | very fast |
| Control | formate | 3.75 | very slow |
| Control | benzoate | 4.19 | very slow |
| Control | acetate | 4.75 | very slow |
| Control | pivalate | 5.00 | very slow |
| Control | p-nitrophenoate | 7.00 | very slow |

very fast = all seven steps have a density of 0.3 above fog
fast = 4, 5 or 6 steps have a density of 0.3 above fog
slow = 1, 2 or 3 steps have a density of 0.3 above fog
very slow = observable density increase, but no step exhibits a density of 0.3 above fog.

EXAMPLES 16 through 25

Ten solutions of the following general composition were prepared:

| Solution F | |
|---|---|
| hexa-ammine cobalt(III) trifluoroacetate (C-3) | 0.21 gram |
| chelate-forming compound | 0.25 millimole |
| 2-isopropoxy-1,4-naphthoquinone (PR-145) | 0.11 gram |
| cellulose acetate butyrate (HS-10) | 1.0 gram |
| acetone | 10.0 ml |

The solutions formed differed solely by the specific choice of chelate-forming compound. The coating and exposure procedures of Examples 4 through 15 were then repeated, and the same criteria were applied for judging the speed of the coatings. The results are summarized in Table XI.

TABLE XI

| Example No. | Exemplary Performance As a Function of Chelate-Forming Compound: Chelate-Forming Compound | Negative Image Color | Speed |
|---|---|---|---|
| 16 | CH-40 | red | fast |
| 17 | CH-37 | cyan | fast |
| 18 | CH-32 | red | fast |
| 19 | CH-23 | green | very fast |
| 20 | CH-26 | green | fast |
| 21 | CH-56 | orange | very fast |
| 22 | CH-60 | orange | fast |
| 23 | CH-46 | magenta | fast |
| 24 | CH-67 | orange | very fast |
| 25 | CH-66 | orange | fast |

EXAMPLES 26 through 35

Ten solutions of the following general composition were prepared:

| Solution G | |
|---|---|
| cobalt(III)complex | 0.25 millimole |
| chelate-forming compound | 0.125 millimole |
| 2-isopropoxy-1,4-naphthoquinone (PR-145) | 0.05 gram |
| cellulose acetate butyrate (HS-10) | 1.0 gram |
| acetone | 10.0 ml |

Coatings were prepared and exposed as in Examples 4 through 15. A sample of each coating was placed after exposure on a heat block held at 140° C. for 5 to 30 seconds to form a negative image. The speed and image color are summarized below. The same criteria as in Table X were used for judging speed, except that the densities were taken directly from the image-forming element.

TABLE XII

| Example No. | Exemplary Performance as a Function of Cobalt(III)Complex: Cobalt(III)-Complex | Chelate-Forming Compound | Negative Image Color | Speed |
|---|---|---|---|---|
| 26 | C-2 | CH-33 | cyan | very fast |
| 27 | C-6 | CH-33 | cyan | very fast |
| 28 | C-4 | CH-33 | cyan | fast |
| 29 | C-15 | CH-35 | red | very fast |
| 30 | C-16 | CH-40 | red | very fast |
| 31 | C-7 | CH-33 | cyan | fast |
| 32 | C-21 | CH-35 | red | very fast |
| 33 | C-32 | CH-33 | cyan | slow |
| 34 | C-33 | CH-33 | cyan | slow |
| 35 | C-34 | CH-33 | cyan | slow |

EXAMPLES 36 through 52

Seventeen solutions of the following general composition were prepared:

| Solution H | |
|---|---|
| hexa-ammine cobalt(III)trifluoroacetate (C-3) | 0.25 gram |
| 1-(2-pyridylazo)-2-naphthol | 0.06 gram |
| photoactivator | 0.25 millimole |
| cellulose acetate butyrate (HS-10) | 1.0 gram |
| acetone | 10.0 ml |

Each solution differed solely by the choice of the photoactivator as indicated in Table XIII below. Each solution was used to prepare coatings on poly(ethylene terephthalate) film support having a wet coating thickness of approximately 100 microns.

Exposure was undertaken using the 400 watt ultraviolet and blue light source of Example 1 after the coating had dried. Exposure of a sample of each coating was made through a 0.3 log E silver step tablet having seven steps ranging in density from 0.05 to 2.15 for 0.5 second. Approximately 10 seconds after exposure each sample was heated by passing through a set of rollers heated to 100° C. The same criteria as in Table X were used for judging speed, except that the densities were taken directly from the image-forming element.

TABLE XIII

| Example No. | Exemplary Performance As a Funtion of Photoactivator: Photoactivator | Speed |
|---|---|---|
| 36 | PR-9 | very fast |
| 37 | PR-17 | very fast |
| 38 | PR-22 | slow |
| 39 | PR-28 | slow |
| 40 | PR-53 | slow |
| 41 | PR-62 | fast |
| 42 | PR-64 | fast |
| 43 | PR-160 | very fast |
| 44 | PR-162 | very fast |
| 45 | PR-165 | very fast |
| 46 | PR-166 | fast |
| 47 | PR-194 | slow |
| 48 | PR-259 | fast |
| 49 | SS-10 | fast |
| 50 | SS-13 | fast |
| 51 | SS-24* | slow |
| 52 | SS-38 | slow |

*tolylsulfonate anion substituted for bromide anion

EXAMPLES 53 through 55

Coatings were prepared, exposed and heated as in Examples 2, 3 and 17. Fixing was achieved by washing from the coating the chelating compound and the photoactivator in a fixing bath consisting of a 5 percent by volume solution of chloroform in 2-propanol. The washing was conducted at room temperature and required from 30 to 90 seconds. A second, final washing was carried out in a 2-propanol. The images were not disturbed by washing, and the clear background areas which did not printout were returned to the exposure unit and given a second, uniform exposure.

EXAMPLE 56

A solution of the following general composition was prepared:

| Solution I | |
|---|---|
| hexa-ammine cobalt(III)trifluoroacetate (C-3) | 0.50 gram |
| 1-(2-pyridylazo)-2-naphthol | 0.12 gram |
| 2-(ethylbenzylamino)-3-chloro-1,4-naphthoquinone (PR-169) | 0.163 gram |
| cellulose acetate butyrate (HS-10) | 1.0 gram |
| acetone | 10.0 ml |

Solution I was coated at about 100 microns wet thickness of a poly(ethylene terephthalate) film support. After drying, a printed document was placed face down onto a sample of the coating, and the sandwich was exposed from the back of the film support for 1 second. The light source for exposure was a 650 watt tungsten filament incandescent lamp providing predominantly visible light commercially available under the tradename Nashua 120 Multi-Spectrum Copier. The printed document was removed, a diazo film was placed in contact with the coating, and the sandwich was passed through a pair of heated rolls at 120° C. to produce a negative copy of the document. The diazo copy exhibited a density in printout areas of from 0.8 to 1.0 and in background areas of 0.05 to 0.1, hereinafter characterized as a good quality image.

EXAMPLE 57

The procedure of Example 56 was repeated, except that the diazo film was replaced by a sample having coated thereon a layer of an alkali bleachable dye consisting of 2,4-diphenyl-6-(β-methyl-3,4-diethoxystyryl)-pyrylium fluoroborate. Similar results obtained, except that a positive of the original printed document was obtained.

EXAMPLE 58

A solution of the following general composition was prepared:

| Solution J | |
|---|---|
| hexa-ammine cobalt(III) trifluoroacetate (C-3) | 0.50 gram |
| 1-(2-pyridylazo)-2-naphthol | 0.12 gram |
| 2-morpholino-3-chloro-1,4-naphthoquinone (PR-170) | 0.138 gram |
| cellulose acetate butyrate (HS-10) | 1.0 gram |
| acetone | 10.0 ml |

Solution J was coated on a poly(ethylene terephahalate) film support at a wet thickness of about 100 microns and dried. A sample of the coating was imagewise exposed for about 0.5 second using the light source of Example 1 and subsequently heat developed in contact with a sample of a diazo film commercially available under the trademark Kodak Diazo Type M film. Heat development was accomplished by placing the diazo film and coated sample in face-to-face contact and passing through a pair of rolls heated to 110° C. A negative, blue image of excellent quality was produced in the diazo film having a density of 1.56 in printout areas.

The coated sample was then uniformly exposed for 2 seconds using the incandescent light source of Example 56. Using a fresh Kodak Diazo Type M film sample and repeating heat development as described above a good quality, high printout density positive diazo film image was obtained.

EXAMPLE 59

The procedures of Example 58 were repeated, except that the image-recording sample of Example 57 was substituted for Kodak Diazo Type M film and the heat development temperature was reduced to 100° C. The first image-recording sample produced a positive image, whereas the diazo film has produced a negative image, and the second image-recording sample produced a negative image, whereas the second diazo film sample produced a positive image. A red dye printout was obtained of excellent density, and image definition was excellent in both image-recording samples.

EXAMPLE 60

A sample of the image-forming element of Example 58 was placed in a camera commercially available under the trademark Kodak Retina III S and common laboratory objects, illuminated by two photoflood lamps, were photographed at a distance of from 3 to 4 feet (f/2.8; 30–60 second exposure; reduction 17X). The exposed film sample was then placed in face-to-face contact with a Kodak Diazo Type M film and the composite was passed through a pair of heated rolls at 100° C. to yield a negative image of good quality. The exposed and processed image-forming film sample was then flashed using the incandescent light source of Example 56 and heat processed a second time in the manner described above using a fresh sample of diazo film. A positive diazo image was then obtained of good quality. Similar results were obtained when an electronic flash was substituted for the photoflood lamps.

EXAMPLE 61

A solution of the following general composition was prepared:

| Solution K | |
|---|---|
| hexa-ammine cobalt(III) trifluoroacetate (C-3) | 0.25 gram |
| 2-isopropoxy-1,4-naphthoquinone (PR-145) | 0.11 gram |
| dithiooxamide | 0.03 gram |
| cellulose acetate butyrate (HS-10) | 1.0 gram |
| acetone | 10.0 grams |

An element corresponding to element 200 in FIG. 5 was prepared using 100 microns poly(ethylene terephthalate) to form the support 202. A radiation-sensitive image-forming layer 204 having a wet coating thickness of approximately 75 microns was formed on the support using Solution K.

After drying, a separation layer 206 was formed on the image-forming layer using the following coating composition: 10.0 grams of toluene and 0.5 grams styrene-butadiene copolymer. The separation layer exhibited a wet coating thickness of approximately 50 microns. Again, after drying a photosensitive, image-recording layer 204 was formed on the support to a wet coating thickness of approximately 100 microns from a composition consisting of 0.02 gram 5-sulfosalicyclic acid; 0.066 gram p-(diethylamino)benzene-diazonium tetrafluoroborate; 0.084 gram naphthol AS-D coupler (commercially available from GAF Corporation) and 0.8 gram cellulose acetate butyrate dissolved in 10 grams of acetone.

A positive image was formed in the following manner: The element was imagewise exposed from the diazo side for 5 seconds using the light source of Example 1. The element was then given a 0.5 second uniform exposure with the same light source through the support and heated for 5 seconds, support down, on a heat block maintained at 115° C. A positive image was obtained. The element exhibited a maximum neutral image density of 1.3 and a neutral minimum background density of 0.07.

EXAMPLE 62

The procedure of Example 61 was repeated, except that a negative image was formed by first imagewise exposing for 0.5 second through the support followed by heating. The residual diazonium salt was destroyed within an overall exposure with the same exposure unit of 7 seconds from the diazo layer side. Background and image densities were identical to those of the preceding example.

EXAMPLE 63

To illustrate that a binderless formulation will work, a solution of the following composition was prepared:

hexa-ammine cobalt(III)trifluoroacetate: 0.125 g
1-(2-pyridylazo)-2-naphthol: 0.025 g
2-isopropoxy-1,4-naphthoquionone: 0.020 g
acetone (solvent): 5 g The solution was imbibed on filter paper. The treated paper was dried and exposed to an exposure unit providing a near UV and blue 400 watt light source commercially available under the tradename IBM Micro Copier II D for 0.5 sec. The exposed sample was then heated for 5 sec. on a 120° C. heat block. A cyan image of reflection density of 1.0 was produced.

EXAMPLE 64

Solutions of the following compositions were prepared, to illustrate that the aromatic groups on both sides of an azo linkage must be capable of forming chelate ligands:

| | |
|---|---|
| Solution A | |
| hexa-ammine cobalt(III)trifluoroacetate | 0.125 g |
| 2-isopropoxy-1,4-naphthoquinone | 0.020 g |
| dimethylformamide (solvent) | 2.5 g |
| Solution B | |
| Orange II 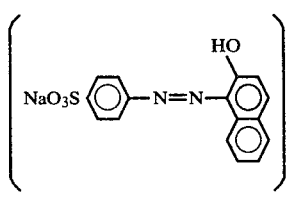 | 0.05 g |
| Water | 2.5 g |

Solutions A and B were thoroughly mixed and the resulting mixture was imbibed on filter paper. The treated paper was dried and exposed for 16 seconds to the IBM Micro Copier II D light source. The exposed sample was then heated for 5 sec. on a 120° C. heat block. Only a very faint image was found.

This example showed that Orange II was not active as a cycling ligand for the system, in view of its inability to produce an image when contrasted with the strong image produced by essentially the same process in Example 63, but using CH-33 as the chelating compound.

The invention has been described in detail with particular reference to preferred embodiments thereof, but it will be understood that variations and modifications can be effected within the spirit and scope of the invention.

What is claimed is:

1. A radiation-sensitive composition exhibiting upon exposure an internal gain comprising, in admixture, a compound containing a conjugated $\pi$-bonding system capable of forming a tridentate chelate with cobalt(III), said compound being defined by one of the formula:

$Z^2—N=N—Z^3$,
$Z^4—CH=N—NH—Z^5$ or
$Z^6—CH=N—Z^7$ wherein $Z^2$, $Z^3$, $Z^4$, $Z^5$, $Z^6$ and $Z^7$ are independently chosen from anong 2-hydroxy, carboxy or amino substituted naphthyl or phenyl; 2-pyridyl; 2-quinolinyl; 2-thiazolyl; 2-benzothiazolyl; 2-oxazolyl; and 2-benzoxazolyl groups, and are each capable of forming chelate ligands, and an inert cobalt(III) complex capable of being reduced by a cobalt(II) complex containing said chelating compound, whereby the cobalt(II) converts to a stable cobalt(III) complex, and a photoreductant capable of forming spontaneously when exposed to activating radiation, or upon subsequent application of heat, a reducing agent capable of reducing said inert cobalt(III) complex, less than 50 mole percent of any acid anions of said composition being those having pKa values greater than 3.5.

2. A composition according to claim 1 in which said photoreductant is chosen from the class consisting of quinone, disulfide, diazoanthrone, diazonium salt, diazophenanthrone, aromatic azide, acyloin, aromatic ketone, aromatic carbazide and diazosulfonate photoreductants.

3. A radiation-sensitive composition comprising, in admixture, (1) a compound containing a conjugated $\pi$-bonding system capable of chelating with cobalt(III) said compound being selected from the group consisting of nitroso-arols, dithiooxamides, formazans, aromatic azo compounds, hydrazones and Schiff bases;

(2) an inert cobalt(III) complex capable of being reduced by a cobalt(II) complex containing said chelating compounds, whereby the cobalt(II) converts to a stable cobalt(III) complex; and (3) a quinone photoreductant which is capable, spontaneously or upon subsequent application of heat, for photoreducing said inert complex, and which incorporates one or more labile hydrogen atoms;

less than 50 mole percent of any acid anions of said composition being those having pKa values greater than 3.5.

4. A composition according to claim 3 in which said labile hydrogen atoms are attached to a carbon atom which is also bonded to the oxygen atom of any oxy substituent or the nitrogen atom of an amine substituent with the further provision that the carbon to hydrogen bond is the third or fourth bond removed from at least one quinone carbonyl bond.

5. An image-forming element as defined in claim 1 wherein said coating is a composite coating comprising two contiguous layers, one of which contains said quinone photoreductant and the other of which contains said cobalt(III)complex and said compound containing said II bonding system.

6. An image-forming element exhibiting upon exposure an internal gain, comprising a support, and as a coating thereon a radiation-sensitive layer comprising, in admixture, a compound containing a conjugated $\pi$-bonding system capable of forming a tridentate chelate with cobalt(III), said compound being defined by one of the formulas:

$Z^2—N{=}N—Z^3$, $Z^4—CH{=}N—NH—Z^5$ or $Z^6—CH{=}N—Z^7$ wherein $Z^2$, $Z^3$, $Z^4$, $Z^5$, $Z^6$ and $Z^7$ are independently chosen from among 2-hydroxy, carboxy or amino substituted naphthyl or phenyl; 2-pyridyl; 2-quinolinyl; 2-thiazolyl; 2-benzothiazolyl; 2-oxazolyl; and 2-benzoxazolyl groups, and are each capable of forming chelate ligands, an inert cobalt(III) complex capable of being reduced by a cobalt(II) complex containing said chelating compound, whereby the cobalt(II) converts to a stable cobalt(III) complex, and a photoreductant capable of forming spontaneously when exposed to activating radiation, or upon subsequent application of heat, a reducing agent capable of reducing said inert cobalt(III) complex, less than 50 mole percent of any acid anions of said coating being those having pKa values greater than 3.5.

7. An image-forming element according to claim 6 in which said photoreductant is chosen from the class consisting of quinone, disulfide, diazoanthrone, diazonium salt, diazophenanthrone, aromatic azide, acyloin, aromatic ketone, aromatic carbazide and diazosulfonate photoreductants.

8. An image-forming element according to claim 7 wherein said photoreductant is a quinone, and further including an adjuvant capable of producing a labile hydrogen atom for reduction of said photoreductant.

9. An image-forming element according to claim 8 in which said labile hydrogen atoms are attached to a carbon atom which is also bonded to the oxygen atom of an oxy substituent or the nitrogen atom of an amine substituent with the further provision that the carbon to hydrogen bond is the third or fourth bond removed from at least one quinone carbonyl bond.

10. An image-forming element according to claim 8 in which said adjuvant is present in a concentration of at least 0.5 mole per mole of said photoreductant.

11. An image-forming element comprising a support, and as a coating thereon, a radiation-sensitive layer comprising, in admixture, (1) a compound containing a conjugated $\pi$-bonding system capable of chelating with cobalt(III), said compound being selected from the group consisting of nitroso-arols, dithiooxamides, formazans, aromatic azo compounds, hydrazones and Schiff bases;

(2) an inert cobalt(III) complex capable of being reduced by a cobalt(II) complex containing said chelating compound, whereby the cobalt(II) converts to a stable cobalt(III) complex; and (3) a quinone photoreductant which is capable, spontaneously or upon subsequent application of heat, of photoreducing said inert complex, and which incorporates one or more labile hydrogen atoms, less than 50 mole percent of any acid anions of said coating being those having pKa values greater than 3.5.

12. An image-forming element according to claim 11 in which said labile hydrogen atoms are attached to a carbon atom which is also bonded to the oxygen atom of any oxy substituent or the nitrogen atom of an amine substituent with the further provision that the carbon to hydrogen bond is the third or fourth bond removed from at least one quinone carbonyl bond.

* * * * *

UNITED STATES PATENT AND TRADEMARK OFFICE

CERTIFICATE OF CORRECTION

PATENT NO. : 4,243,737

DATED : January 6, 1981

INVENTOR(S) : Thap DoMinh

It is certified that error appears in the above-identified patent and that said Letters Patent are hereby corrected as shown below:

Col. 56, line 22, "anong", should read --among--.

Col. 57, line 9, "II", should read --$\pi$--.

Signed and Sealed this

*Nineteenth* Day of *May 1981*

[SEAL]

*Attest:*

RENE D. TEGTMEYER

*Attesting Officer*

*Acting Commissioner of Patents and Trademarks*